US006094106A

United States Patent [19]

Kishino et al.

[11] Patent Number: 6,094,106

[45] Date of Patent: Jul. 25, 2000

[54] NON-RADIATIVE DIELECTRIC WAVEGUIDE MODULE

[75] Inventors: Tetsuya Kishino; Takeshi Okamura, both of Kokubu, Japan

[73] Assignee: Kyocera Corporation, Kyoto, Japan

[21] Appl. No.: 09/104,089

[22] Filed: Jun. 24, 1998

[30] Foreign Application Priority Data

| | | | |
|---|---|---|---|
| Jun. 25, 1997 | [JP] | Japan | 9-168637 |
| Jul. 30, 1997 | [JP] | Japan | 9-205017 |
| Aug. 22, 1997 | [JP] | Japan | 9-226173 |
| Sep. 25, 1997 | [JP] | Japan | 9-260059 |
| Oct. 29, 1997 | [JP] | Japan | 9-297051 |
| Feb. 23, 1998 | [JP] | Japan | 10-040809 |

[51] Int. Cl.[7] ..... H01P 1/22; H01P 1/26; H01P 3/12

[52] U.S. Cl. ..... 333/22 R; 333/81 B; 333/113; 333/239; 333/248; 333/249

[58] Field of Search ..... 333/22 R, 81 B, 333/113, 239, 248, 249

[56] References Cited

U.S. PATENT DOCUMENTS

| | | | |
|---|---|---|---|
| 5,523,727 | 6/1996 | Shingyoji | 333/239 X |
| 5,604,469 | 2/1997 | Ishikawa et al. | 333/248 X |
| 5,770,989 | 6/1998 | Ishikawa et al. | 333/248 |
| 5,861,782 | 1/1999 | Saitoh | 333/248 X |

*Primary Examiner*—Paul Gensler
*Attorney, Agent, or Firm*—Hogan & Hartson L.L.P.

[57] ABSTRACT

A module equipped with a non-radiative dielectric waveguide in accordance with this invention comprises a pair of parallel flat conductors arranged at a space of ½ or below of a high frequency signal wavelength λ and a dielectric strip extending between these parallel flat conductors. This dielectric strip is formed from a cordierite ceramic having a dielectric constant of 4.5 to 8, especially 4.5 to 6. Conversion of an electromagnetic wave of LSM mode to an electromagnetic wave of LSE is minimal. When the module has a dielectric strip having a steep curved portion having a small radius of curvature, the transmission is possible with a low loss, and the band width of a high frequency signal is broad.

23 Claims, 16 Drawing Sheets

NON-RADIATIVE DIELECTRIC WAVEGUIDE MODULE

BACKGROUND OF THE INVENTION

1. Field of the Invention

This invention relates to a module of a non-radiative dielectric waveguide, for example a non-radiative dielectric waveguide module used in a millimeter wave integrated circuit a millimeter wave transceiver, automotive radar system and the like.

2. Description of the Prior Art

The non-radiative dielectric waveguide (NRD guide) has a structure in which dielectric strips are provided between a pair of parallel flat conductors disposed in a space of ½ or below of a used high frequency signal wavelength λ. With an NRD having such a structure, high frequency signals having a wavelength larger than λ are cut off and cannot enter into the space between the parallel flat conductors. Furthermore, high frequency signals can be transmitted along the strip, and radiations from the dielectric wave guide are suppressed by the cut-off effects of the parallel flat conductors.

It is known that modes of propagation on NRD guide are an LSM mode and an LSE mode. Generally, the LSM mode is used because of its small loss.

Furthermore, since in such an NRD guide, by providing a dielectric strip in a curved shape, a high frequency signal can propagate easily along it, small circuit size or any other convenient circuit design can be easily implemented.

As a material for the dielectric strip, resins such as Teflon and polystyrene have been used in view of its easy processability.

However, in an NRD guide provided with a dielectric strip formed from such a resin, there is a transmission loss at a curved portion (to be simply called bending loss) or a transmission loss in a line conjugating portion is large, and for example, there is a problem that an abrupt bend having a small radius of curvature cannot be formed. Furthermore, when a gentle bend having a large radius of curvature is formed, the radius of curvature should be established precisely. Furthermore, the band width of a bend is extremely narrow as about 1 to 2 GHz in the vicinity of 60 GHz. In an NRD guide equipped with dielectric strips formed from such a resin, the dispersion curves of LSM mode and LSE mode are close to each other as shown in FIG. 22 below. As a result, the frequency difference between these modes is a very small value of about 3 GHz. Thus, a part of electromagnetic waves of the LSM mode is converted to LSE mode.

There is also an NRD guide using alumina as a material of the dielectric strip. However, in this case, to be used in a high frequency region of at least 50 GHz, the width of a strip should be markedly narrow. It is extremely difficult to process or mount the strip and this NRD guide is not practical.

SUMMARY OF THE INVENTION

It is an object of this invention to provide a module of a non-radiative dielectric waveguide (NRD guide) in which conversion of an electromagnetic wave of an LSM mode into an LSE mode is low and even when the NRD guide has a dielectric strip having a small radius of curvature and an abrupt curved portion, the frequency band width in which the transmission is possible with a low loss is broad.

Another object of this invention is to provide a module of an NRD guide with high degree of freedom in circuit design and processing and in which the circuits can be shaped into small sizes.

According to this invention, there is provided a module of a non-radiative dielectric waveguide comprising a pair of parallel flat conductors arranged with a space of ½ or below of a signal wavelength λ and a dielectric strip arranged between the parallel flat conductors, wherein the dielectric strip is formed from a dielectric having a dielectric constant of 4.5 to 8, particulary 4.5 to 6.

According to this invention, there is further provided a module of a non-radiative dielectric waveguide comprising a pair of parallel flat conductors arranged with a space of ½ or below of a signal wavelength λ and a dielectric strip arranged between the parallel flat conductors, wherein the dielectric strip is constructed with a first strip and a second strip adjacent to each other, a high frequency signal transmitting through the first strip or the second strip passes the adjacent portion and is outputted from the first and the second strips, and a transmissivity curve obtained by plotting the transmissivity with respect to the frequency of a high frequency signal outputted from each strip has an extreme value at a desired frequency.

DETAILED DESCRIPTION OF THE INVENTION

Figure 1:
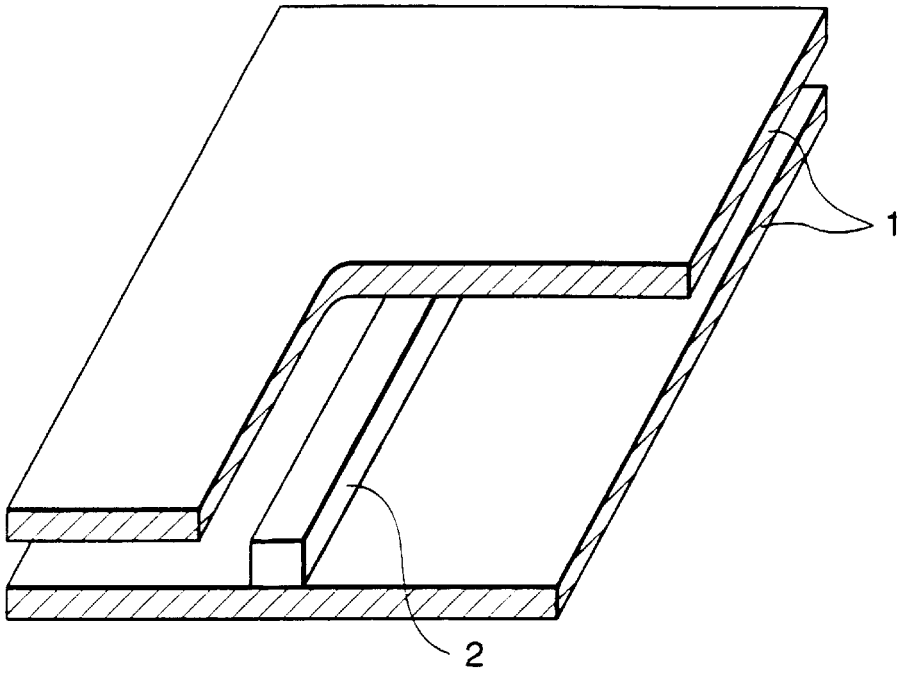
FIGS. 1 and 2 show a basic structure of NRD guide module.
Figure 2:
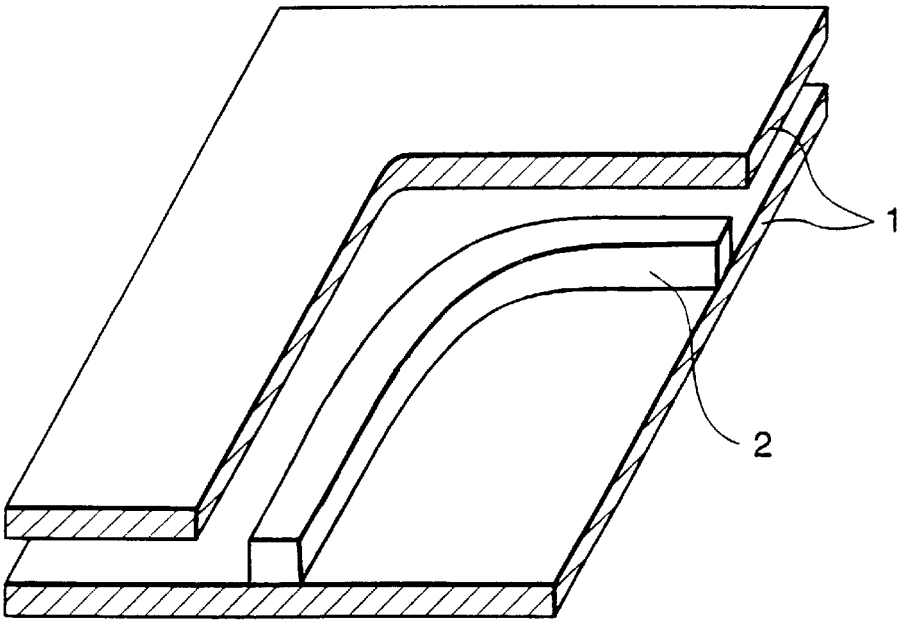

In FIGS. 1 and 2 showing the basic structure of the NRD guide module, this module is provided with a pair of parallel flat conductors 1,1 and a dielectric strip 2 sandwiched between the parallel flat conductors 1,1. In FIGS. 1 and 2, for easy understanding, a part of the upper parallel flat conductor 1 is cut off.

The space between the parallel flat conductors 1,1 is prescribed at ½ or below of the used signal wavelength λ. When such limitation is imposed, a high frequency signal having a wavelength larger than λ is prevented from intruding between the parallel flat conductors 1,1, and radiation of the electromagnetic wave from the strip 2 is suppressed. Furthermore, the high frequency signal can transmit along the strip 2. But this strip 2 can be formed in a linear shape as in FIG. 1, or may be formed in the form of a curved shape as in FIG. 2.

The marked characteristic of this invention is that the strip 2 is formed by using a dielectric having a dielectric constant of 4.5 to 8, especially 4.5 to 6. The resin material such as conventionally used Teflon or polystyrene has a dielectric constant of 2 to 4. Alumina has a dielectric constant of about 10. The dielectric used in this invention as a material for the strip 2 has a dielectric constant intermediate between the above-mentioned materials. According to this invention, by forming the strip 2 comprising a dielectric having such a dielectric constant, the conversion of electromagnetic wave of the LSM mode to an LSE mode can be decreased. Accordingly, when a steep bend having a small radius of curvature is provided on the strip 2, a band width in which the transmission loss due to bending (bending loss) is small becomes broader. For example, when a dielectric having a dielectric constant of smaller than 4.5 is used, conversion of the electromagnetic wave of an LSM mode to an LSE mode is large and the advantage of this invention will be lost. Furthermore, when a dielectric having a dielectric constant of greater than 8 is used, transmission of a high frequency signal having a frequency of at least 50 GHz requires that the width of the strip 2 should be made slender markedly, and problems occur in processing tolerances or strength.

Dielectrics used as the forming material for the strip 2 in this invention should have a Q value (quality factor) of at least 1000, preferably at least 2000, most preferably at least 2500, at a frequency of 60 GHz. Dielectrics having such Q values have enough low losses to apply for the transmission lines used in microwave bands and millimeter wave bands in recent years.

As the dielectric having the above-mentioned dielectric constant, a cordierite ceramic can be exemplified. The cordierite ceramic contains a complex oxide containing Mg, Al and Si as a main component. For example, when the mole composition of these metal elements is expressed by the following formula $$xMgO.yAl_2O_3.zSiO_2$$

wherein x, y and z are numbers satisfying the x+y+z=100, x, y and z satisfy the following conditions, $10 \leqq x \leqq 40$, especially $15 \leqq x \leqq 35$, most preferably $20 \leqq x \leqq 30$, $10 \leqq y \leqq 40$, especially $17 \leqq y \leqq 35$, most preferably $17 \leqq y \leqq 30$, $20 \leqq z \leqq 80$, especially $30 \leqq z \leqq 65$, most preferably $40 \leqq z \leqq 60$.

The cordierite ceramic containing Mg, Al and Si in the above proportions has a high Q value at 60 GHz and is extremely advantageous in this invention.

When x showing the content of MgO is, for example, less than 10, it is impossible to obtain a good sintered product and the Q value is low. When x is larger than 40, the dielectric constant of the sintered product becomes high. In order to increase the Q value at 60 GHz to at least 2000, x should be in the range of 15 to 35. To increase the Q value to at least 2500, x is preferably in the range of 20 to 30.

When y showing the content of $Al_2O_3$ is less than 10, it is impossible to obtain a good sintered product in the same way as in the above-mentioned case, and the Q value is low. When y is larger than 40, the dielectric constant of the sintered product becomes higher. To increase the Q value at 60 GHz to at least 2000, y should be preferably in the range of 17 to 35. To increase the Q value to at least 2500, y should be preferably in the range of 17 to 30.

When z showing the content of $SiO_2$ is less than 20, the dielectric constant of the sintered product becomes high. When it exceeds 80, it is impossible to obtain a good sintered product, and the Q value becomes low. To increase the Q value at 60 GHz to at least 2000, z should be preferably in the range of 30 to 65. To increase the Q value to at least 2500, z should be preferably in the range of 40 to 60.

The above-mentioned cordierite ceramic should preferably contain a Group 3*a* element in the periodic table. A cordierite ceramic containing a Group 3*a* element in the periodic table has an advantage that it has most preferred dielectric constants in this invention and high Q values, and firing conditions for obtaining fully densified sintered products are mild. For example, if a material not containing a Group 3*a* element in the periodic table is used, a densification-firing temperature range is about 10° C. But if the material contains such an element, the densification-firing temperature range is broadened to about 100° C., and there is an advantage that mass production is easy. Furthermore, by controlling the speed of the thermal descent from the sintering temperature (for example, 100° C./hour or below), the oxide added of Group 3*a* element can be precipated as a disilicate $Re_2Si_2O_7$ (Re=Group 3*a* element) having a low dielectric constant and a high Q value. Therefore, the sintered product having a low dielectric constant and a high Q value can be obtained whereby the firing temperature range can be broadened.

The Group 3*a* elements in the periodic table include Sc, Y, La, Ce, Pr, Nd, Pm, Sm, Eu, Gd, Tb, Dy, Ho, Er, Tm, Yb, and Lu. In the present invention, Yb (ytterbium) is preferred. Based on the above complex oxide, Yb should be contained in an amount of 0.1 to 15% by weight, especially in an amount of 0.1 to 10% by weight, calculated as $Yb_2O_3$. If the content of Yb is less than 0.1% by weight, an densification-firing temperature range does not become broad, and the ceramic is dissatisfactory in regard to the mass production. If the ceramic contains Yb in an amount of more than 15% by weight, the sintered product has a large dielectric loss, and has a lowered Q value. Generally, when the content of Yb becomes greater, the densification-firing temperature range of the cordierite ceramic becomes broader. On the other hand, the dielectric constant of the sintered product becomes higher and the Q value of the sintered product becomes lower. It is desirable to determine the content of Yb according to the balance between the dielectric constant or the Q value and the densitication-firing temperature range.

The cordierite ceramic most preferably used in this invention has a composition of the complex oxide by mole ratio of x=22.2, y=22.2 and z=55.6 and containing 0.1 to 10% by weight of Yb calculated as $Yb_2O_3$.

To obtain the cordierite ceramic, a starting material containing Mg, Al and Si, may be used, and as required, a powder containing a Group 3*a* element may further be used. These starting materials may contain inorganic compounds such as an oxide, a carbonate, and an acetate or organic compounds such as organic metals so long as these materials may form the oxides by firing. For example, as supply sources of these elements, $MgCO_3$ powder, $Al_2O_3$ powder, $SiO_2$ powder, and $Yb_2O_3$ powder may be used. For example, such starting powders are wet-mixed in predertermined proportions and dried, and the mixture is calcined at 1100 to 1300° C. in air, and pulverized. A suitable amount of a binder is added to the resulting powder, and the resulting product is molded into a predetermined shape (the shape of the strip 2). The molded product was fired in air at a temperature of 1200 to 1550° C. whereby a strip composed of the cordierite ceramics can be formed.

The cordierite ceramic so obtained contains cordierite as a main crystal phase, but according to the composition of the starting powder, phases such as mullite, spinel, protoenstatite, clinoenstatite, cristobalite, forsterite, tridymite, sapphirine and $Yb_2Si_2O_7$ may be precipitated as sub-crystal phases. When the dielectric constants and the Q values of the sintered product are within a predetermined range, no problem occurs even if such a sub-crystal phase is precipitated. Ca, Ba, Zr, Ni, Fe, Cr, P, Na, and Ti derived from starting materials or milling balls may be contained as impurities in the cordierite ceramics for forming a strip. However, there is no particular problem so long as the dielectric constants or the Q values are within the above range.

In the NRD guide module of this invention provided with a strip 2 composed of a dielectric having a specific dielectric constant, an abrupt curved portion having a small radius of curvature can be formed in a strip 2. Hence, the invention provides significant freedom of circuit design, and it is extremely advantageous in small sizing of the circuit or in the lowering of the cost, and the circuit can be produced very accurately. The circuit is very useful for transmitting high frequency signals having a frequency of at least 50 GHz.

Since, in the NRD guide module of this invention, the dielectric constituting the strip 2 has a higher dielectric constant than a resin material such as Teflon, it is advantageous that the resin material hardly affects on it. When parts arranged in the vicinity of a strip 2 such as a supporting jig of a cirucuit base plate or a strip are prepared from such a resin material, transmission property is not lowered. Therefore, the circuit design in this case is not constrained and small size and low cost circuits can be designed with excellent results.

Structure of the Module:

Various electronic component parts or circuits may be added to the module provided with a non-radiative dielectric waveguide (NRD guide) constructed of a strip 2 composed of a dielectric having a dielectric constant of 4.5 to 8 and a pair of parallel flat conductors 1,1. The parallel flat conductors 1 are preferably formed from a conductor plate such as Cu, Al, Fe, stainless steel, Ag, Au, and Pt because they have a high electric conductivity and excellent processability. The conductors 1 may have such a structure that a conductor layer composed of the above metal may be formed on an insulated substrate.

Figure 3:
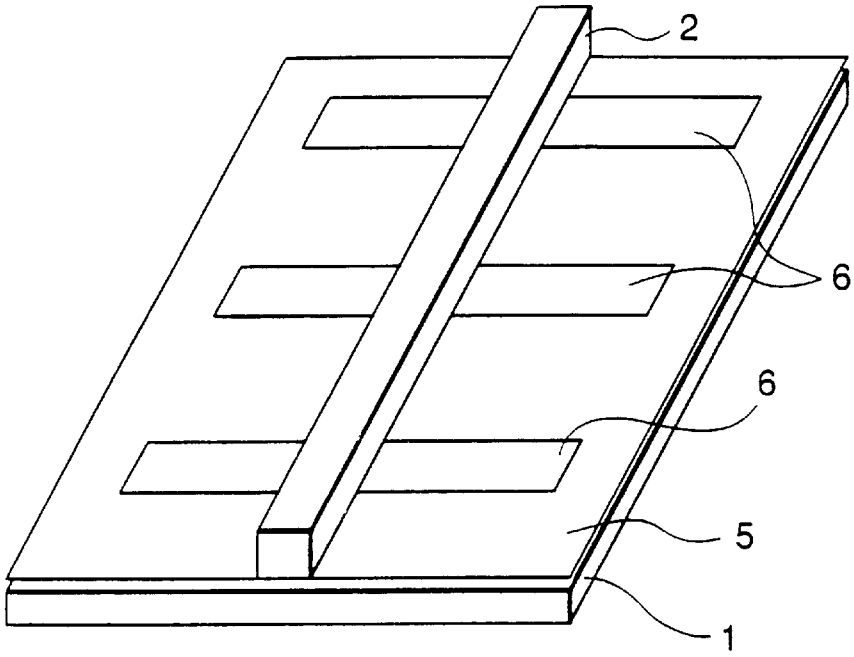
FIG. 3 shows a basic structure of an example in which an insulated film is provided on the parallel flat conductor in the module of FIG. 1.
Figure 4:
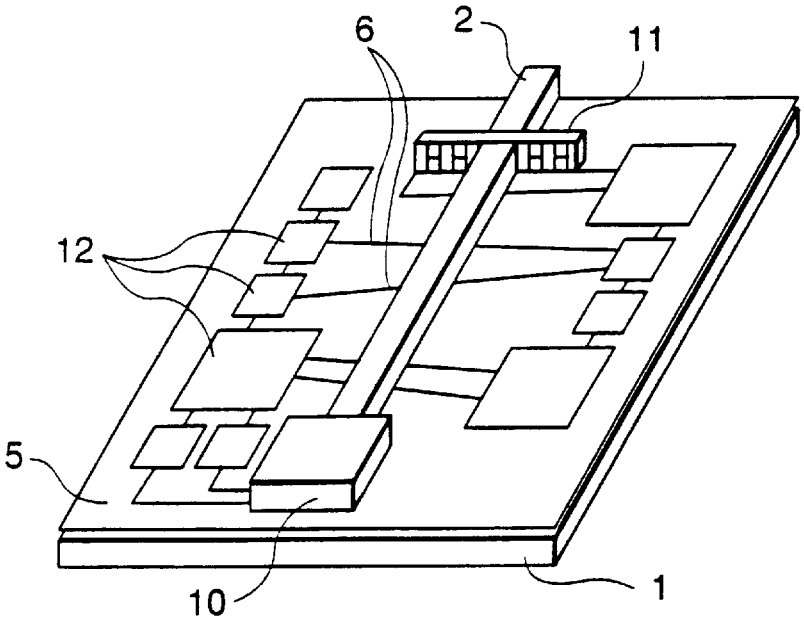
FIG. 4 shows a specific example of the module of FIG. 3.

For example, in this invention, an insulated film may be provided on the surface of the parallel flat conductor in which the strip 2 is provided. On the insulated film layer, various electronic component parts may be provided. FIG. 3 shows the basic structure of the module on which such an insulated film layer is provided. FIG. 4 shows a specific example thereof. In these drawings, the upper parallel flat conductor 1 is omitted for convenience of explanation.

As shown in FIG. 3, in this example of this invention, an insulated film layer 5 is provided on the upper surface of the parallel flat conductor 1, namely on that surface in which the strip 2 is provided. A conductor pattern 6 is formed on the insulated film layer 5. Various electronic component parts are provided on the insulated film layer 5, but these electronic component parts are connected to the strip 2 or the conductor pattern 6. As shown in FIG. 4, an oscillator device 10 for high frequency signals is arranged in the forward end portion of the strip 2, and on the way of the strip 2, an input or output device 11 provided with a semi-conductor element such as a diode is provided. Furthermore, various electronic component parts 12 such as an oscillator of modulation signals or an integrated circuit are connected to a conductor pattern 6 formed on the insulated film layer 5. Since in an embodiment in which the insulated film layer 5 is provided, various electronic component parts can be accommodated between a pair of pararell flat conductors 1,1, the thickness of the module can be thinned, this is very advantageous to make the module available as a card-type, and it is also very advantageous to perform mass production. For example, in a module provided with a conventional non-radiative dielectric waveguide, the above-mentioned electronic component parts 12 were provided on an insulated substrate fixed on that side of the parallel flat conductor 1 on which the strip 2 is not provided. In such a case, the thickness of the module necessarily becomes large, and the module cannot be free from inconvenience in respect of conversion of the module built in the computer into a card-type. Furthermore, when an insulated substrate is fixed to the parallel flat conductor 1, and in order to connect an appendant electronic component part to an oscillator device or a signal input or output device connected to the strip 2, it becomes necessary to provide a hole in the insulated substrate or the parallel flat conductor. Accordingly, there is a problem with respect to mass production. However, it is understood that the embodiments shown in FIGS. 3 and 4 effectively dissolve such problems.

The insulated film layer 5 may be formed from any desired material unless transmission characteristics of the NRD guide composed of the strip 2 and a pair of parallel flat conductors 1 are not greatly deteriorated, but this insulated film layer 5 should generally have a dielectric constant of at least 5 or below, and a thickness of 0.3 mm or below. When the insulated film layer 5 is formed of a material having a dielectric constant of more than 5 or has a thickness of more than 0.3 mm, perturbation occurs in electromagnetic waves transmitted through the dielectric strip to give a cause of reflection or radiation. Suitable materials for an insulated film may include resins such as polyacetate, Teflon, cellophane, polyvinyl chloride, polystyrene, polyethylene and polyethylene terephthalate; glass pastes and glass-ceramic pastes. Laminated paper obtained by laminating the above resins on paper may also be used. Accordingly, these films may be applied to the parallel flat conductors by using an adhesive or an adhesive tape, or the glass paste or glass-ceramic paste is coated on the parallel flat conductor and then the coated product is heat-treated to form an insulated film layer 5.

The strip 2, the conductor pattern 6, the oscillator device 10 and the electronic component parts 12 can be provided on the film layer 5 after the insulated film layer 5 is provided on the parallel flat conductor 1. Alternatively, the strip 2 is provided on the resin film, and thereafter, the resin film may be applied to the parallel flat conductor 1. When the strip 2 or the electronic component part 12 is provided on the resin film layer 5, to prescribe the applying position of these members accurately, it is desirable to clearly specify the installing position in the insulated film layer 5 or the insulated resin film by means of printing. The thickness of the conductor pattern 6, or the quality of the material of the conductor pattern 6 and the method of forming the conductor pattern 6 on the insulated film layer 5 are not particularly limited, but it is preferred that the thickness of a portion passing immediately below the strip 2 should be limited to 0.1 mm or below. A method of connecting the electronic component part 12 to the conductor pattern 6 is not particularly limited. For example, connecting can be performed by using an electroconductive paste, an electroconductive adhesive agent, or a solder. Usually, any desired adhesive agent may be used to secure the strip 2 on the insulated film layer 5. As far as the transmission characteristics or strength of the strip 2 are not impaired, any adhesive agent may be used. Furthermore, the insulated film layer 5 may be provided on the entire surface of the parallel flat conductor 1, or may be provided only on a portion on which the electronic component part 12 or the conductor pattern 6 is provided.

Figure 5:
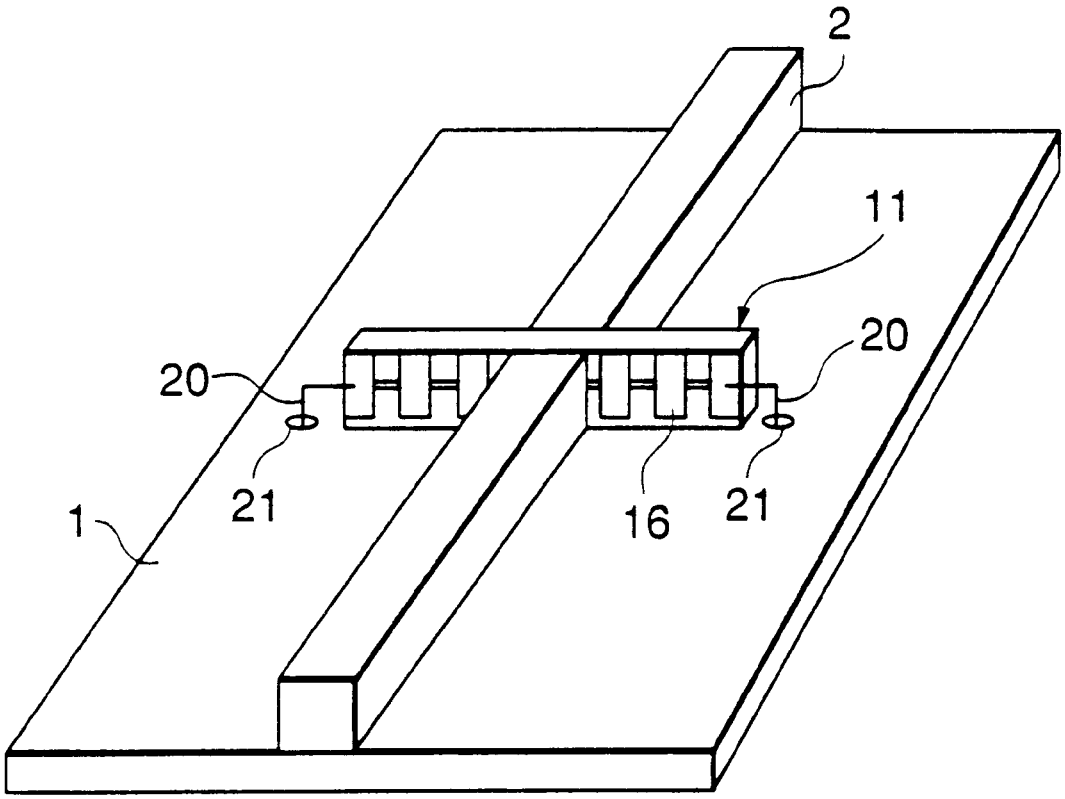
FIG. 5 shows a basic structure of an example in which a signal input or output device on the way of the dielectric strip of the module of FIG. 1.

In the module of this invention, on the way of the strip 2, a signal input or output device provided with a semiconductor element such as a diode may be installed. By this provision, the module can have various functions such as conversions of frequencies of signals, switching, decay and detection. For example, in FIG. 4, this signal input or output device is shown by 11. A basic NRD guide in which such a signal input or output device 11 is provided is shown in FIG. 5, and a pattern structure formed in the signal input or output device 11 is shown in FIG. 6.

Figure 6:
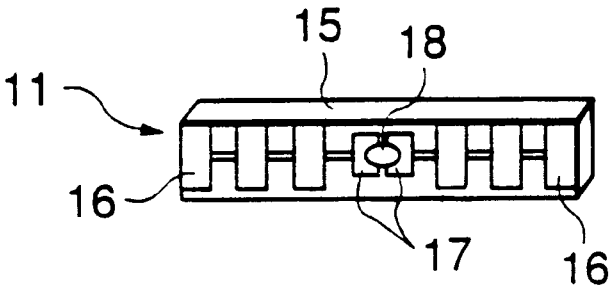
FIG. 6 shows a pattern surface of the signal input or output device of FIG. 5.

The above signal input or output device 11 is formed from a dielectric substrate 15 interposed on the way of the strip 2, and on one main surface of the dielectric substrate 15, as clearly shown in FIG. 6, a pair of choke patterns 16,16 for preventing the leakage of high frequency signals to an outside portion, and a pair of antenna patterns 17,17 for receiving the high frequency signals are formed. The choke pattern 16,16 is connected to each of the antenna patterns 17,17, and a semi-conductor element 18 such as a diode is disposed between the antenna patterns 17,17 and is connected to the antenna patterns 17,17. The above antenna pattern 17 is arranged in a portion covered with the strip 2, namely in a transmission passage of high frequency signals. Furthermore, an input or output conductor 20 is connected to the choke pattern 16, and this input or output conductor 20 extends outwardly through a hole 21 provided in the parallel flat conductor 1 and is connected to various electronic component parts. Accordingly, when the insulated film layer is provided as shown in FIG. 4, the conductor pattern 6 corresponds to the input or output conductor 20, and such a hole 21 should not particularly be formed.

When the signal input or output device 11 is provided, since the dielectric substrate 15 is inserted in a transmission passage of high frequency signals, namely in a portion on which electromagnetic waves are concentrated, there is a defect that transmission characteristics will be deteriorated. For example, because a part of high frequency signals is transmitted to the inside of the dielectric substrate 15 and dissipated, a loss occurs in the signals. Furthermore, since the dielectric substrate 15 has a thin thickness and a large length, it is difficult to arrange the dielectric substrate 15 accurately, and it is risky during production or use of the module that the dielectric substrate 15 shifts in position or is damaged.

Figure 7:
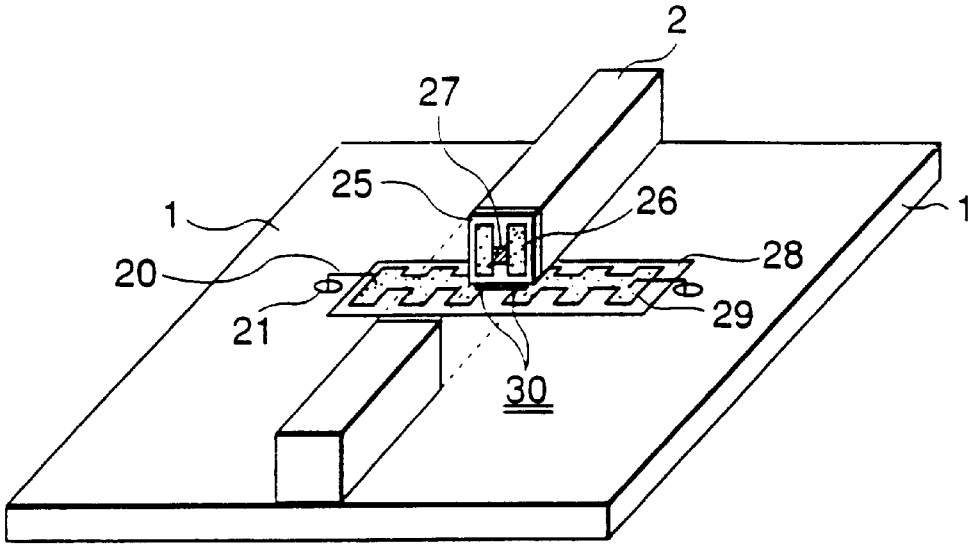
FIG. 7 shows a basic structure of a module formed by providing a choke pattern in the input or output device on the parallel flat conductor.

However, according to this invention, by forming the choke pattern in the input or output device 11 on the parallel flat conductor 1, the above-mentioned problems can be circumvented. This example is shown in FIG. 7. In FIG. 7, like FIG. 5, the upper parallel flat conductor 1 is omitted.

In the module of FIG. 7, a dielectric substrate 25 having substantially the same sectional shape as the strip 2 is inserted on the way of the strip 2, and a pair of antenna patterns 26,26 are formed on the surface of the dielectric substrate 25 (a surface corresponding to a vertical section of the strip 2). A semi-conductor element 27 is connected between the antenna patterns 26,26. Furthermore, an insulated layer 28 is formed on the parallel flat conductor 1, and on the insulated layer 28, a choke pattern 29 is formed. This choke pattern 29 is connected to the antenna pattern 26 through an electrode 30. Furthermore, this choke pattern 29 is connected to the conductor 20 extending outwardly through the hole 21 provided in the parallel flat conductor 1 in the same way as in an example shown in FIG. 5. Input or output conductor 20 connected to various electronic component parts.

According to such a structure, the choke pattern 29 is not formed on a vertical section of the strip 2 on which the electromagnetic waves are concentrated. Accordingly, this choke pattern 29 does not adversely affect high frequency signals transmitted through the strip 2, but can increase the transmission characteristics of high frequency signals. Since the dielectric substrate 25 may have the same size as the vertical section of the strip 2, its installation is easy, the accuracy of the position is high, and during production or use of the module, shift of the position or damage does not occur.

The dielectric substrate 25 may preferably be formed from the same dielectric material as the strip 2. The insulated layer 28 may be formed from the same insulating material constituting the insulated film layer 5 formed in an example of FIG. 4, and this insulating material may have a thickness of about 10 $\mu$m to about 200 $\mu$m. This insulated layer 28 can be formed on the parallel flat conductor 1 by a sputtering method, a vacuum evaporation method, a printing method, and a dipping method, and an insulated film may be formed by using an adhesive agent, or an adhesive tape. As the semi-conductor element 27, examples may include a high frequency diode, a Gunn diode, an IMPATT diode, a variable capacitance diode, Schottky diode, a varactor and a PIN diode. However, the semi-conductor elements used in this invention are not limited to these examples, and electronic component parts having functions such as an inductor, a capacitor and a transistor may be used.

The antenna pattern 26 and the choke pattern 29 may preferably be formed from Au, Cu and Al having high electric conductivity. Furthermore, these patterns 26 and 29 may be formed on the dielectric substrate 25 or the insulated layer 28 by using a vacuum evaporation method, but they may also be formed by pasting a thin metal plate molded into a predetermined pattern shape. The input or output device is basically used for detecting or modulating high frequency signals, but it may be used for sending high frequency signals or other signals. When used for modulating high frequency signals, it is necessary to connect a feeder line for inputting modulation signals to the antenna pattern 26. Modulation signals may be input to the antenna pattern 26 through the choke pattern 29. In an example shown in FIG. 7, the choke pattern 29 is preferably such that the pattern space is adjusted to ¼ $\lambda$ choke which has been obtained by prescribing ¼ of the wavelength of a high frequency signal. Such a choke pattern is equivalent to an inductor (choke coil) shutting off a high frequency signal, and can prevent the outward leakage of the high frequency signal effectively.

An electrode 30 can be formed by means of extending the antenna pattern 26 to the lower portion of the dielectric substrate 25, or providing another electrode in the lower portion of the dielectric substrate 25. This electrode 30 may be connected to the choke pattern 29 by using a solder or an electroconductive adhesive agent.

Input or output of the signals, such as modulation signal, from the choke pattern 29 may be carried out through the input or output conductor 20. The hole 21 through which the conductor 20 passes is filled with an insulating material in its inside, or the inner wall of the hole 21 is coated with the insulating material, whereby the conduction between the conductor 20 and the parallel flat conductor 1 is prevented. Of course, the input or output conductor 20 may be coated with an insulating tube. When as in an example of FIG. 4 the insulated film layer 5 is provided on the parallel flat conductor 1, such an input or output conductor 20 may be replaced by a conductor pattern 6. In this case, there is no need to provide the hole 21.

Figure 8:
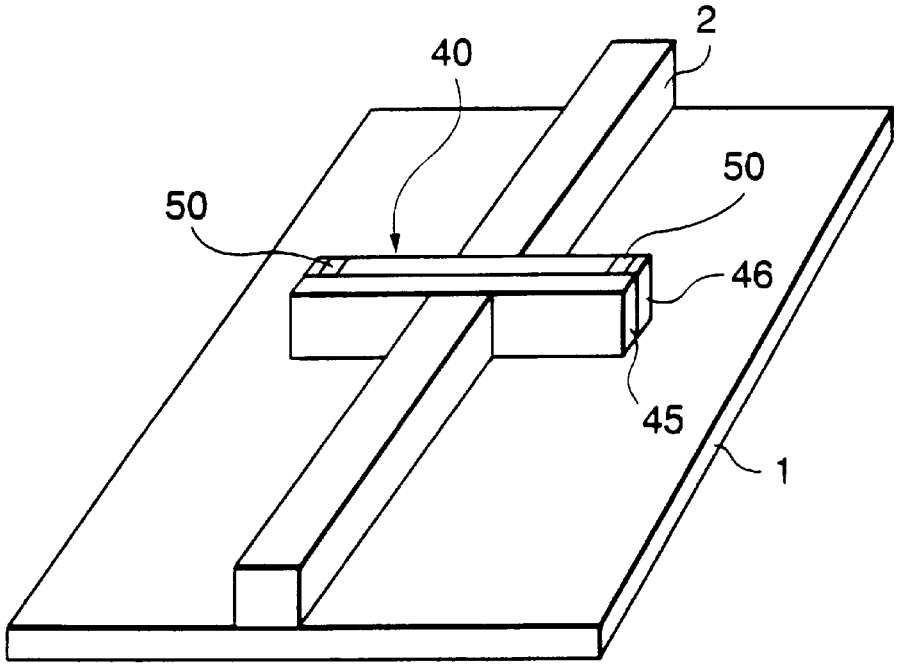
FIG. 8 shows a basic structure of a module obtained by providing a signal input or output device in which patterns or a semi-conductor element are built.
Figure 9:
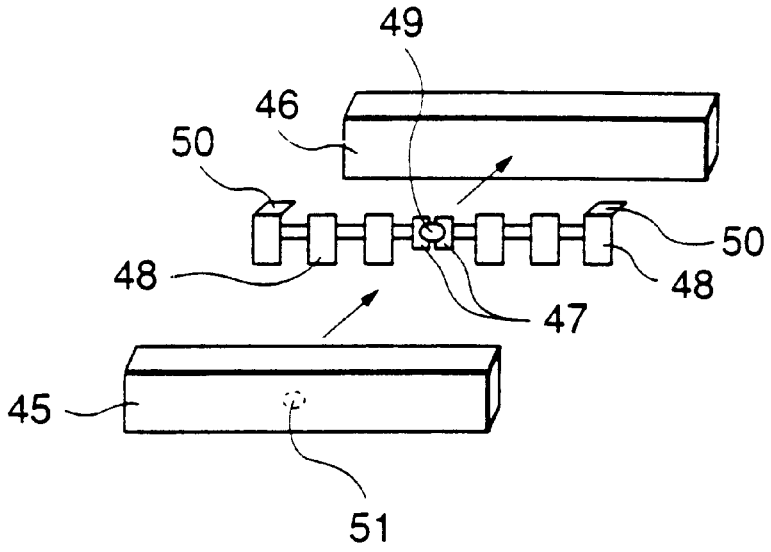
FIG. 9 is a decomposed perspective view of the signal input or output device of FIG. 8.

FIG. 7 shows an example in which a choke pattern in the device 11 is provided on the parallel flat conductor 1 separately from the antenna pattern. However, these antenna pattern and the choke pattern may be built in the dielectric substrate. FIG. 8 shows a basic structure of a module provided with an input or output device (shown by 40), and FIG. 9 shows a decomposed perspective view of the signal input or output device 40. In FIG. 8, the upper parallel flat conductor 1 was omitted.

As clearly seen from FIGS. 8 and 9, this signal input or output device 40 is provided with a pair of dielectric substrates 45 and 46, and between the dielectric substrates 45 and 46, a pair of antenna patterns 47,47, a pair of choke patterns 48,48, and a semi-conductor element 49 are arranged. Each choke pattern 48 is connected between the antenna patterns 47,47. A surface electrode 50 formed on the dielectric substrate 45 or 46 is connected to the choke pattern 48 (in FIG. 8, the surface electrode 50 is formed on the upper surface of the dielectric substrate 46). Furthermore, a concave portion 51 for accommodating a semi-conductor element is formed on one dielectric substrate 45, and in this portion, the semi-conductor element 49 may be arranged. Of course, this concave portion 51 may be formed on the other dielectric substrate 46, or it may be formed on both of the dielectric substrates 45 and 46. By arranging the semi-conductor element 49 on this concave portion 51, it is possible to adhere the dielectric substrates 45 and 46 intimately. Hence, the strength of this apparatus 40 can be increased, and its thickness may be thinned.

A suitable input or output conductor (not shown) may be connected from the surface electrode 50 in the same way as in FIG. 7. This conductor is extended outwardly through a hole formed in the parallel flat conductor 1, and is connected to various electronic component parts or circuits. Furthermore, as in FIG. 4, when the insulated film layer is provided on the parallel flat conductor 1, the surface electrode 50 may be directly connected to the conductor pattern formed on the film layer.

Since in the module equipped with the signal input or output device 40, the antenna, choke pattern, and the semi-conductor element are protected by the dielectric substrate, a possible damage to these members may be effectively prevented during the production or use of the module. Furthermore, since in the conventional signal input or output device, the semi-conductor element is provided on the surface of the dielectric substrate as explained in FIGS. 5 and 6, a space corresponding to the thickness of the semi-conductor element is formed in a portion connecting to the strip 2. Accordingly, there is a problem that reflection of a high frequency signal is easy to occur due to mismatching of the impedance. When the signal input or output device 40 shown in FIGS. 8 and 9 is used, because a conjugating portion between the strip 2 and the dielectric substrate becomes flat, impedance matching becomes easy, and a marked advantage is obtained in that the band width of a high frequency signal having good transmission characteristics is broadened. Furthermore, since the strip 2 is connected in a flat surface, the signal input or output device 40 can be arranged at a predetermined position stably and with a good accuracy, and position shifting can be effectively prevented.

In the above-mentioned FIGS. 8 and 9, the antenna pattern 47 and the choke pattern 48 can be formed in the same way as described in an example shown in FIG. 7, and the surface electrode 50 can be formed by extending the choke pattern 48, or by providing an electrode separately, and by connecting these to the choke pattern 48 by using a solder or an electroconductive adhesive agent.

Figure 10:
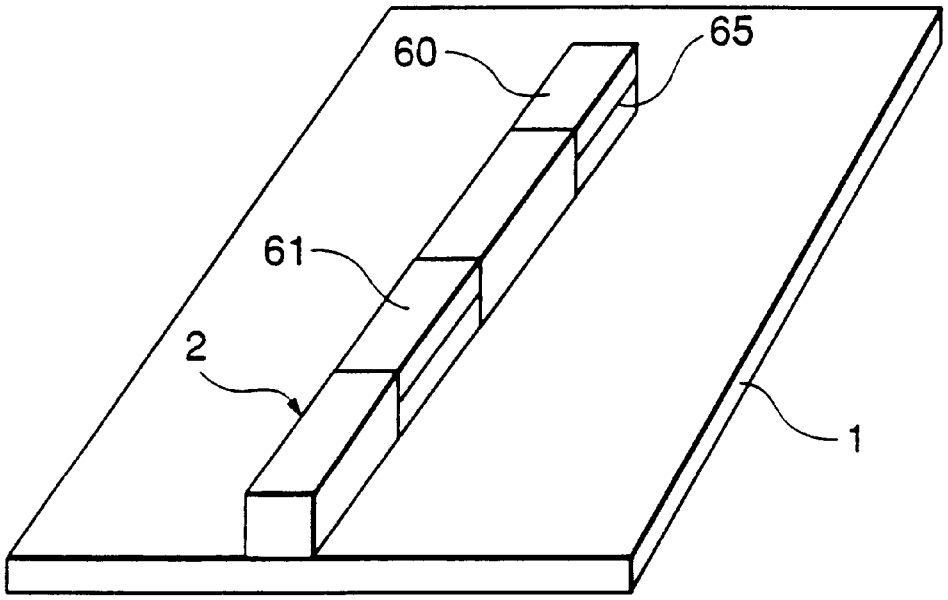
FIG. 10 shows a basic structure of a module having a terminator and an attenuator equipped with an electromagnetic wave absorber.
Figure 11A:
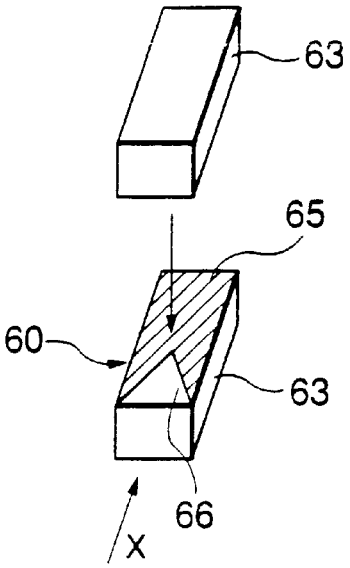
FIGS. 11A and 11B show the structures of the terminator and the attenuator, respectively.
Figure 11B:
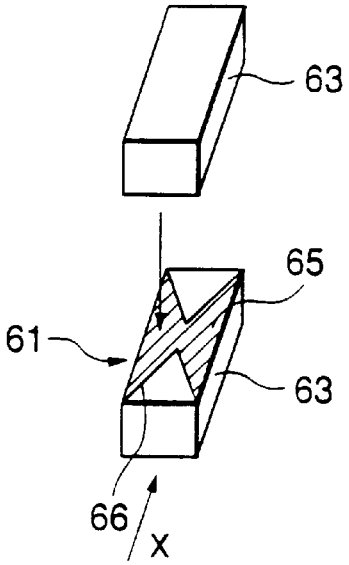

In the various type modules mentioned above, an electromagnetic wave absorber can be provided to decay or extinguish an electromagnetic wave on the way of the strip 2 or in a terminal portion. The electromagnetic wave is liable to be reflected in a terminal portion of the strip, but when such a reflection occurs, the high frequency device will be adversely affected, and an input signal wave and a reflection signal wave are composed to form a phenomenon of a standing wave. In order to suppress such a reflection, a terminator equipped with an electromagnetic wave absorber can be installed in a terminal portion of the strip 2. Furthermore, to protect the high frequency device, an attenuator provided with an electromagnetic wave absorber can be installed in a suitable portion on the way of the strip 2 so that input signal power may be decayed. FIG. 10 shows a basic structure of a module having a strip equipped with such a terminator and such an attenuator. The structure of the terminator is shown in FIG. 11A, and the structure of the attenuator is shown in FIG. 11B. In the module of FIG. 10, both of an attenuator and a terminator are provided at the strip 2, but an attenuator only or a terminator only can be provided. In FIG. 10, the upper parallel flat conductor 1 is omitted.

As is clear from these figures, in the terminator 60 provided at the terminal of the strip 2, and the attenuator 61 provided on the way of strip 2, an electromagnetic wave absorber 65 is sandwiched between dielectric pieces 63,63 forming a strip. This electromagnetic wave absorber 65 is positioned at a central portion in the thickness direction of the strip 2 because this portion has the strongest electric field in a transverse direction. By arranging the electromagnetic wave absorber 65 in this portion, it is thought that an electromagnetic wave can be decayed or extinguished most efficiently. Furthermore, in the above electromagnetic wave absorber 65, a groove 66 is formed in an end portion opposite to a propagating direction X of the electromagnetic wave in the terminator 60 and formed in both end portions along the propagating direction X in the attenuator 61. These grooves 66 are formed for matching the impedances of the device and the strip 2, The terminator 60 and the attenuator 61 equipped with the electromagnetic wave absorber 65 are generally employed. However, these devices cannot have enough characteristic of decaying or extinguishing the electromagnetic wave. For example, when the above terminator 60 is used, the length of the electromagnetic wave absorber 65 should be adjusted to about 20 mm in order to fully extinguish the electromagnetic wave and prevent reflection, and the above fact exerts an evil influence to the small sizing of the module. Furthermore, since such a device must be produced separately and should be secured to the strip 2, position shifting or damage may easily occur. As a result of extensively investigating such a device, the present inventors have found that the above problem can be dissolved by providing an electromagnetic wave absorber on the side of the strip 2.

Figure 12:
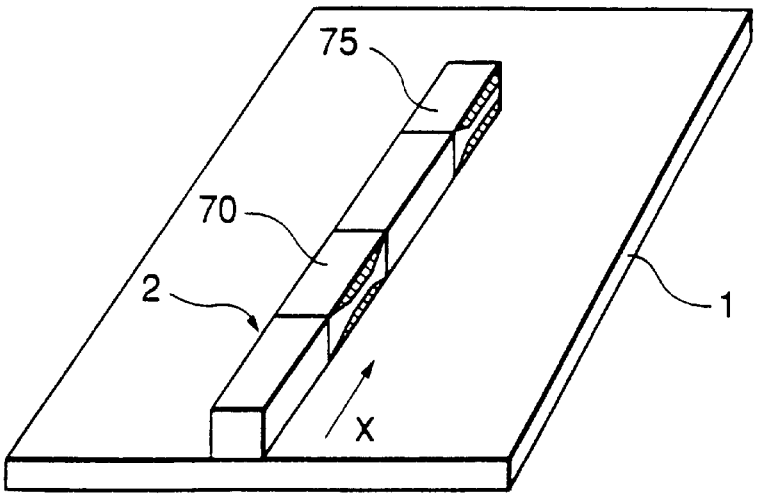
FIG. 12 shows a basic structure of a module having a strip with electromagnetic wave absorbers on the side of it.
Figure 13A:
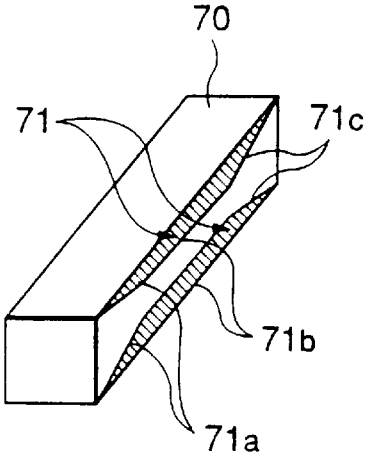
FIGS. 13A and 13B show an enlarged and exploded view of the attenuator portion of the strip.
Figure 13B:
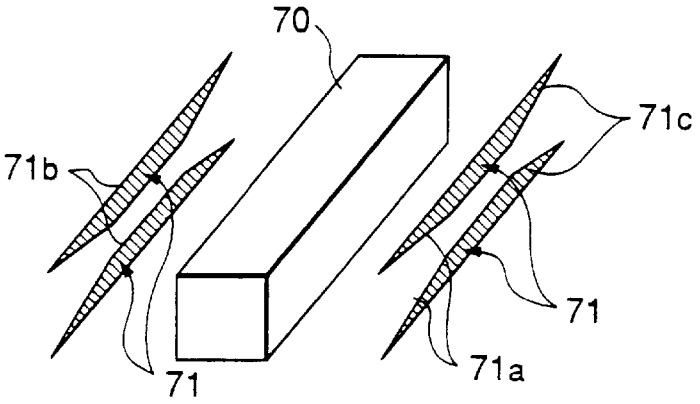
Figure 14A:
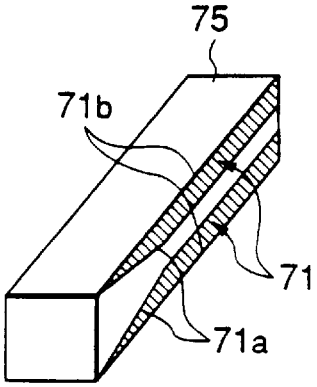
FIGS. 14A and 14B show an enlarged and exploded view of the terminal portion of the strip, respectively.
Figure 14B:
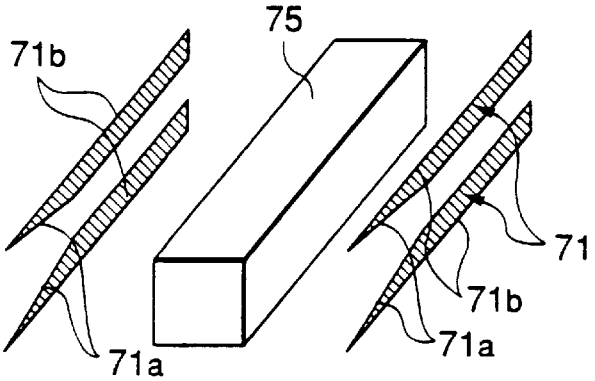

FIG. 12 shows a basic structure of a module having a strip provided with the electromagnetic wave absorber on the side of it. FIG. 13A shows an enlarged view of a decaying portion of the strip, and FIG. 13B shows an exploded of the portion view. FIG. 14A shows an enlarged view of a terminal portion of the strip, and FIG. 14B shows an exploded view of the portion.

In these Figs., electromagnetic wave absorbers 71 are provided in four places which are the upper ends and the lower ends in side surfaces of a decaying portion 70 on the way of the strip 2. The electromagnetic wave absorbers 71 are provided in both side surfaces of the strip 2. Sometimes, the electromagnetic wave absorber 71 may be provided on only one side surface. Or it may be provided in only one of the upper end portion or the lower end portion. According to such an embodiment, the electromagnetic wave can be decayed or extinguished with great efficiency in comparison with a case of using the attenuator or the terminator shown in FIGS. 10 and 11. When the distribution of the electromagnetic field of NRD guide is examined, it has been confirmed that a portion having a strong electric field in a vertical direction exists at the upper end and the lower end in the sides of the strip 2. Accordingly, by providing an electromagnetic wave absorber in this portion, it is possible to decay or extinguished an electromagnetic wave with good efficiency. Furthermore, according to this embodiment, the electromagnetic wave absorber 71 can be very simply provided by printing method or vacuum evaporation method by using an adhesive agent on the side surface of the strip 2. As shown by an example of FIG. 10 or 11, it is not necessary to produce an attenuator or a terminator separately from the strip 2, and it is advantageous from the standpoint of productivity. The electromagnetic wave absorber is stably held in a predetermined position, and there is no problem such as position shifting and moreover, the technique has very good reliability.

Preferably, in the electromagnetic wave absorber 71, a taper portion 71a having a gradually broader width in the propagating direction X of the electromagnetic wave is formed in an end portion on the side of incidence of the electromagnetic wave, and joining this taper portion 71*a*, a belt-like portion 71*b* having a constant width is formed. Furthermore, it is preferred that in the electromagnetic wave absorber 71 provided in the decay portion 70, a taper portion 71*c* having a gradually narrower width in the progressing direction X of the electromagnetic wave is provided in an end portion on the side of the exit of the electromagnetic wave. By using such a form of the electromagnetic wave absorber 71, it is possible to increase the characteristics of attenuation and extinguishing of a high frequency signal to a maximum degree. The width of the belt-like portion 71*b* of the electromagnetic wave absorber 71 is not limited in size unless the reflection of the signal or the change of the mode does not become larger. However, the size may be adjusted to about 10 to 40% of the height (corresponding to the space between the parallel flat conductors 1,1) of the strip 2 in view of the fact that good attenuation characteristics and reflection preventing characteristics may be obtained. The length of the electromagnetic wave absorber 71 is prescribed so that the desired attenuating characteristics or extinguishing characteristics may be obtained. As stated above, according to this embodiment, a short length of the electromagnetic wave absorber 71 may give sufficient attenuating and terminating. The above-mentioned electromagnetic wave absorber 71 provided on the side of the strip 2 can also be provided on the side surface of the terminator or attenuator shown in FIGS. 10 and 11.

In the above-mentioned examples, the electromagnetic wave absorbers 65 and 71 may be formed from any desired resistive materials or wave absorber materials. But to obtain efficient attenuating characteristics, a nickel-chromium alloy or carbon may be used as the resistive materials. The electromagnetic wave absorber materials include Permalloy and Sendust.

In modules having various structures provided with the NRD guide, by arranging some of strips adjacently, signals transmitting through the strip may be divided and coupled. The coupled structure (may be referred to simply as "coupler") may be divided into structures shown in FIGS. 15 and 16.

Figure 15:
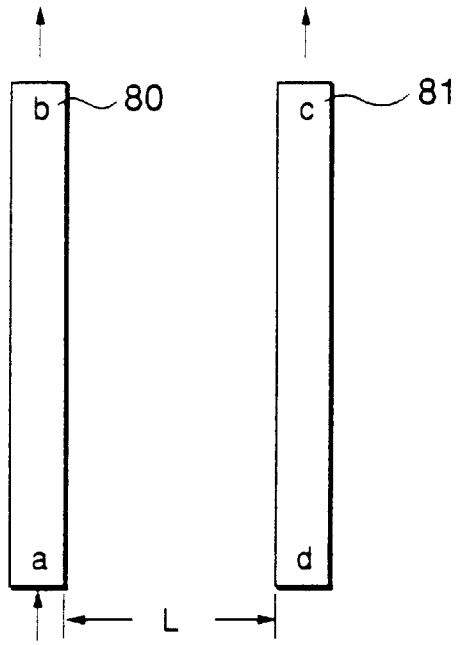
FIGS. 15 and 16 show typical examples of a coupling structure (coupler) of two strips.

In FIG. 15, to a first linear strip 80, a second linear strip 81 is adjoined with a space L, and in this coupler, the strips 80 and 81 are symmetrically arranged. In this case, the first strip 80 and the second strip 81 may have a curved shape having the same radius of curvature.

Figure 16:
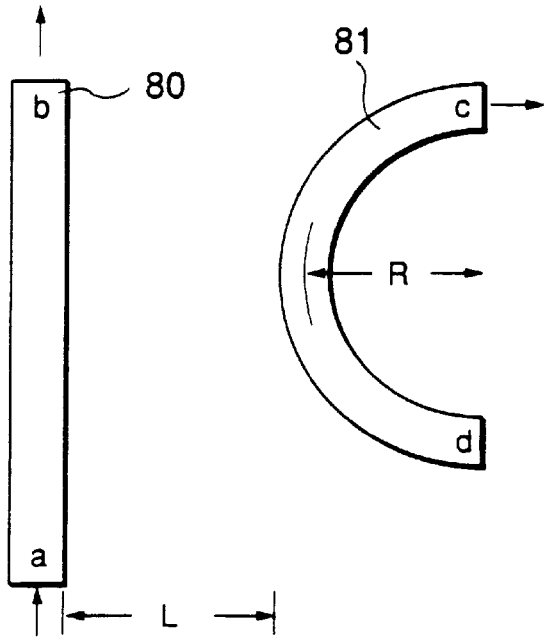

In FIG. 16, a first linear strip 80 is adjacent to a second curved strip 81 having a curved shape having a radius of curvature R. The second strip 81 is closest to the first strip 80 in the curved portion, and the space between them is L. In this coupler, strips 80 and 81 are arranged non-symmetrically. In this case, the first strip may have a curved portion which is much larger than the above-mentioned radius of curvature.

In the couplers shown in FIGS. 15 and 16, a part of a high frequency signal (electromagnetic wave) incident from a port a of the first strip 80 is transmitted directly through an adjacent portion and is outputted from a port b, and the remainder is electromagnetically coupled to the second strip 81 at the above adjacent portion and is outputted from a port c. The electromagnetic wave incident from a port d of the second strip 81 is divided in the same way as above and is outputted from the port b and the port c. Furthermore, when electromagnetic waves are simultaneously incident to the port a and the port d, the divided electromagnetic waves are mixed and outputted from the port b and the port c. In these cases, the proportion (division ratio) of the electromagnetic waves outputted from the port b and the port c may be generally adjusted by varying the space L between the two strips 80 and 81.

Figure 17:
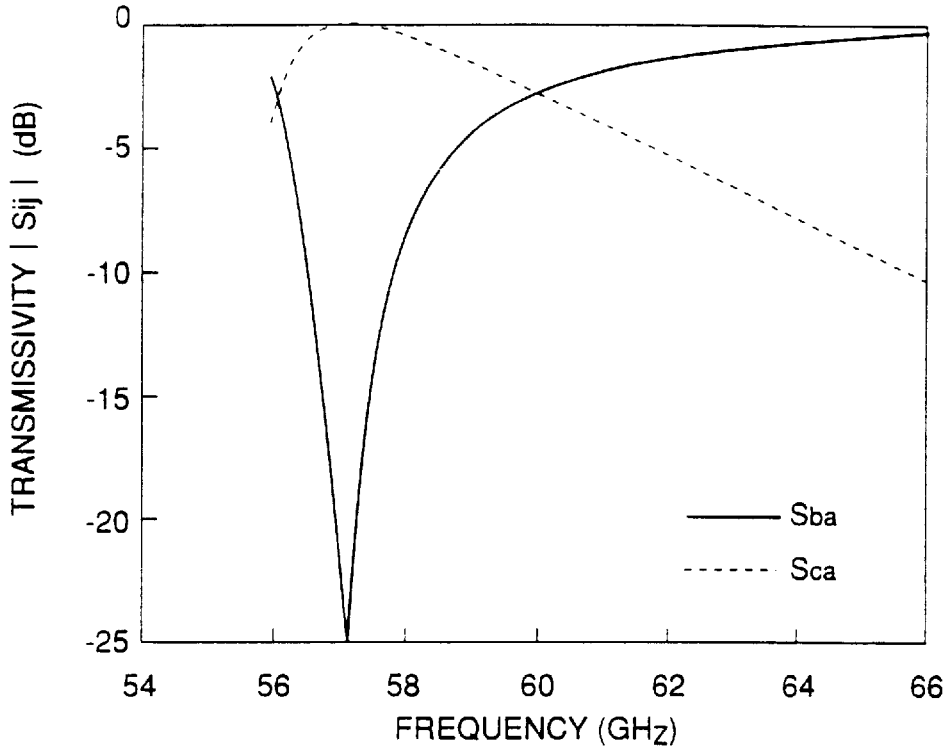
FIG. 17 is a view showing the relation between the frequency and the transmissivity of a symmetrical coupler used conventionally.
Figure 18:
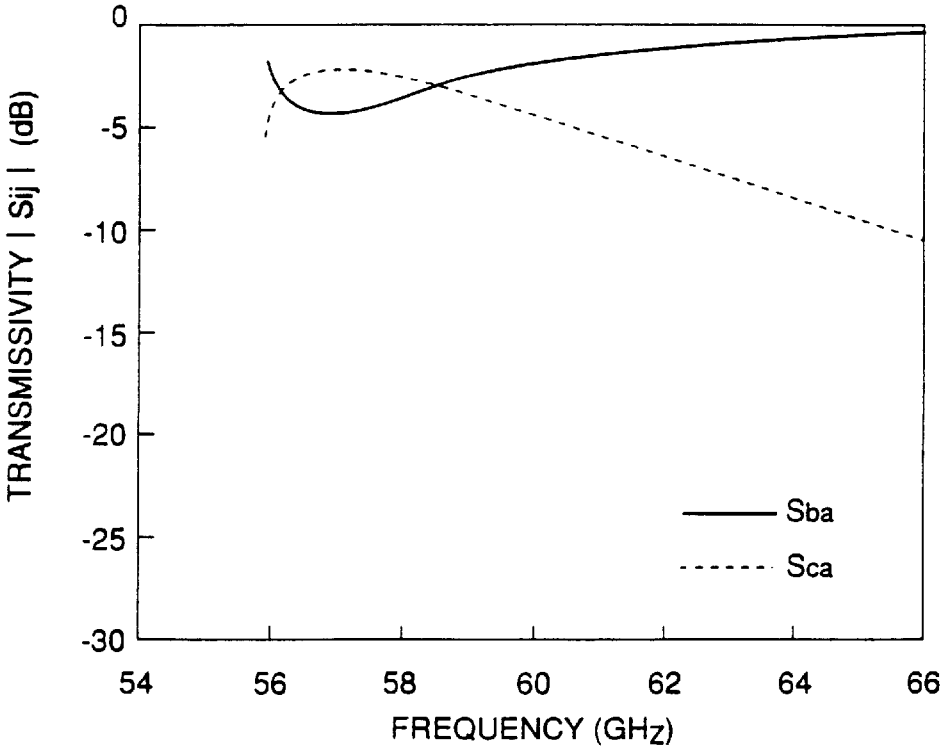
FIG. 18 is a view showing the relation between the frequency and the transmissivity of a non-symmetrical coupler used conventionally.

When a high frequency signal having a frequency of 60 GHz incident from the port a is divided into the port b and the port c, the relation between the frequency and the transmissivity is sought by calculation with regard to the conventionally employed symmetrical couplers, and this relation is prescribed as shown in FIG. 17. Furthermore, with regard to a non-symmetrical coupler, the relation is prescribed as shown in FIG. 18. In FIGS. 17 and 18, Sba shows a transmissivity curve of a high frequency signal outputted to the port b, and Sca shows a transmissivity curve of a high frequency signal outputted to the port c.

As is clear from these figures, couplers were prescribed so that the curve Sba and the curve Sca might cross each other at the frequency (60 GHz). In the case of non-symmetrical coupler, it is understood that the transmissivity at the port c is smaller than the symmetrical coupler, and furthermore, the intersecting point between the above curves is shifted to a lower frequency number. Furthermore, since in the case of non-symmetrical couplers, two adjacent strips become non-symmetrical, there is a problem that a high frequency signal may not be outputted with a calculated transmissivity to a port c. In view of these points, a symmetrical coupler especially shown in FIG. 15 was employed in a conventional module. When one strip is shaped in the form of a straight line, and the other strip is formed in a curved shape, couplers are designed so that the radius of curvature of the curved strip is adjusted to as large as possible, and the symmetry of the strips is increased.

Since the design options in the presently employed couplers are limited, designing modules of a small size becomes a great problem. Furthermore, as can be understood from FIG. 17, when symmetrical couplers are used, the transmissivity varies greatly in the vicinity of the frequency of the used signal. Namely, when the frequency is shifted slightly from 60 GHz, the transmissivity will be greatly changed. For this reason, the band width of the used frequency of conventional couplers is extremely small as about 1 GHz. In machines used in communication which require a broad frequency band width, it is difficult to use such couplers. When the space L between the strips 80 and 81 varies, the transmissivity greatly changes. Thus, it is necessary to strictly define the space L between these strips and this hinders an increasing mass production of the modules.

Figure 19:
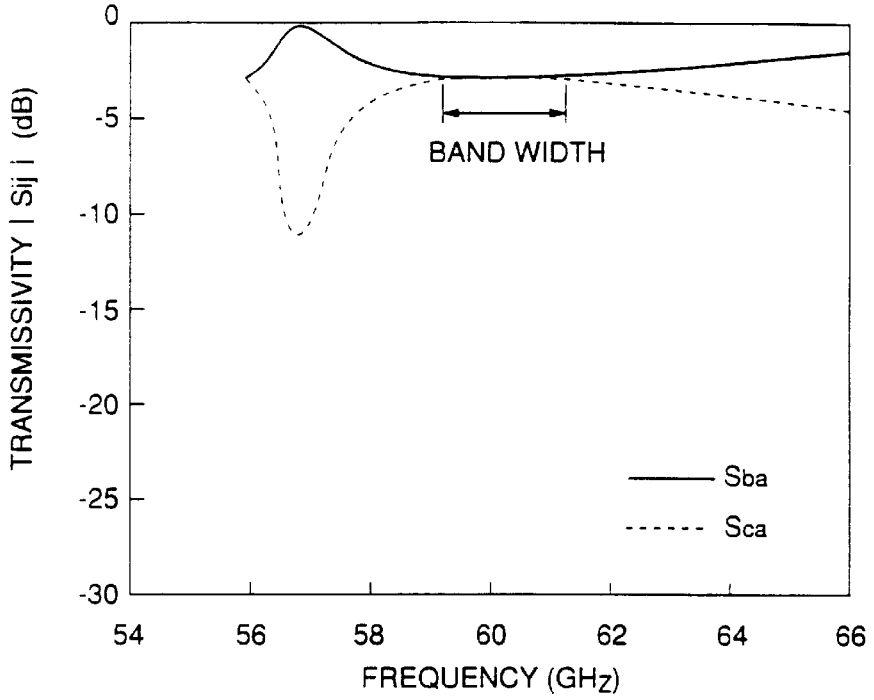
FIG. 19 is a view showing the relation between the frequency and the transmissivity of a coupler used preferably in this invention.

The present inventors have found that the above-mentioned problems can be avoided effectively by prescribing the strips 80 and 81 so that when curves obtained by plotting a transmissivity against the frequency of a signal are prepared with respect to the adjacent strips 80 and 81, each curve may have an extreme value at a frequency of a used signal. FIG. 19 showing the results of calculating the relation between the frequency and the transmissivity with respect to the strips 80 and 81 should be referred to. In the curves shown in FIG. 19, both the curve Sba and the curve Sca have an extreme value at a frequency of 60 GHz (the curve Sba has a minimum value, and the curve Sca has a maximum value). When couplers prescribed as above are used, the inclination of the transmissivity curve is very small in the vicinity of a used frequency (60 GHz), and thus, a belt-like region having a small variation in a transmissivity is broadened. Hence, the band width of the frequency becomes broad, and it is possible to use such couplers effectively in machines which require broad frequency band widths, such as communication. Since a belt-like region having a small variation in transmissivity is broad, even when the space L between two strips 80 and 81 changes somewhat, the transmissivity does not greatly vary, and signals can be divided and coupled with prescribed ratio. As a result, the mass productivity of the modules increases. As shown in FIG. 19, it is preferred that extreme values of two curves of transmissivitys at the used frequency should be adjusted to the same values, whereby the 3 dB coupler in which signals are equally divided is obtained.

The extreme value of the transmissivity and the frequency at which the transmissivity shows the extreme value depend upon the radius of curvature of the adjacent portion of the strips 80 and 81, the space L between the strips 80 and 81, the width and height of the strips 80 and 81, and the dielectric constant. Accordingly, a transmissivity curve is sought by experiment or calculation according to the desired frequency, and these values (the radius of curvature, the width and height, the dielectric constant, and the space) of the strips should be prescribed so that the above conditions may be satisfied. For example, when the high frequency signal is incident from the port a, the radius of curvature R in an adjacent portion of the second strip 81 decreasing, the minimum value of the transmissivity into the port b increases, and the maximum value of the transmissivity to the port c is decreased. When the difference between the radius of curvature in the adjacent portions of the two strips becomes greater, the extreme value of the transmissivity to the port b becomes smaller.

Accordingly, in this embodiment, the first strip 80 may be linear, and the second strip 81 may have a curved shape in which the radius of curvature of the adjacent portion is small, whereby the design flexibility of structure of the coupler markedly becomes higher, and this is extremely advantageous in small sizing of the module.

In such a structure of the coupler, the dielectric constants of the strips 80 and 81 should preferably be at least 4, especially from 4.5 to 10, in practical applications. Accordingly, such a coupler is optimum in using the above-mentioned strip formed from a dielectric having a dielectric constant of 4.5 to 8, especially 4.5 to 6. When a strip having such a dielectric constant is used, the radius of curvature R of the second strip 81 should preferably be adjusted to not larger than 8 mm. Furthermore, the first strip 80 may have a curved structure if the conditions relating to the above transmissivity curve are held, but it may be a linear shape in general. Incidentally, by using a strip having a height of 2.25 mm, a width of 1.0 mm and a dielectric constant of 5, making a first strip 80 linear, and adjusting the radius of curvature R at an adjacent portion of the second strip 81 to about 4 mm, 3 dB couplers may be obtained in which the transmissivitys of the port b and the port c become equal at 60 GHz.

Of course, in such couplers, the strips 80 and 81 can be formed from a dielectric having a dielectric constant of less than 4, especially a dielectric constant of 2 to 3. In this case, the radius of curvature R at an adjacent portion of the second strip 81 should be adjusted to not larger than 12 mm. Especially, the first strip should preferably be made linear.

As explained above, the module of this invention equipped with an NRD guide formed from a dielectric having a dielectric constant within a fixed range can take various structures.

An example of using the NRD guide module as a millimeter wave transceiver will be explained on the basis of FIG. 31.

Figure 31:
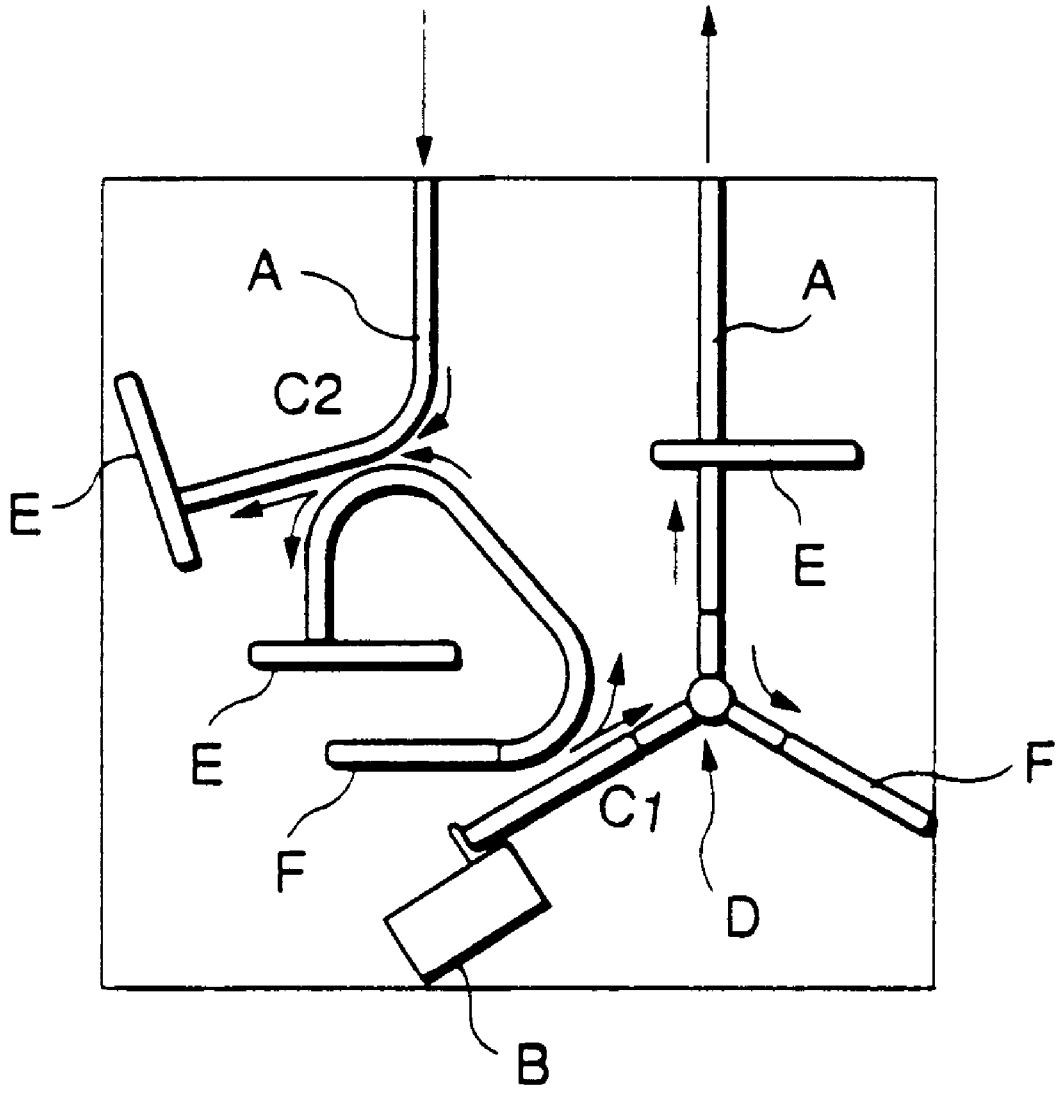
FIG. 31 shows a module of this invention used in a millimeter wave tranceiver.

In the module of FIG. 31, millimeter wave is oscillated at a Gunn diode (millimeter wave oscillator) B arranged at a forward end of the dielectric strip A, and a part of the millimetric wave is divided into local waves by a coupler C1. The remaining wave is input to a signal input or output device E through a circulator D, modulated by the signal input or output device E, and for example, radiated toward an automobile running ahead. To protect the Gunn diode B from the reflection of the millimeter wave which is caused of the signal input or output device E, the reflected wave is circuited toward a terminating device F by the circulater D.

A received wave reflected from the automobile ahead propagates through the dielectric strip A. Received wave and local wave are combined at the coupler C2 and then inputted to signal input or output devices E which are at the end of the dielectric strip A and the coupler C2, respectively. The respective signals are output from the signal input or output devices E. Incidentally, the terminator F is provided at one terminal portion of the coupler C1.

The following examples will illustrate the present invention.

EXPERIMENTAL EXAMPLE 1

First, a cordierite ceramic used as a dielectric strip was prepared.

As a starting powder, $MgCO_3$ having a purity of 99%, $Al_2O_3$ having a purity of 99.7%, $SiO_2$ having a purity of 99.4% and $Re_2O_3$ (Re=Group 3*a* element) having a purity of 99.9% were weighed so that the sintered product had the composition shown in Tables 1 and 2. The starting powders were wet-mixed for 15 hours and dried, and the mixture was calcined in air at 1200° C. for 2 hours and thereafter pulverized. A suitable amount of a binder was added to granulate the mixture, and the mixture was molded under a pressure of 1000 kg/cm$^2$ to obtain a molded product having a diameter of 12 mm and a thickness of 8 mm. The molded product was fired in air at a temperature of 1200 to 1550° C. for 2 hours to prepare a porcelain. It was then polished to prepare a dielectric porcelain sample having a diameter of 5 mm and a thickness of 2.25 mm.

Using this sample, its dielectric constant at a frequency of 60 GHz and its Q value were measured by using a dielectric resonator method. The results are shown in Tables 1 and 2.

A ceramic plate was cut off, and a dielectric strip having a curved portion having a radius of 3.9 mm and 90° was prepared. Using the dielectric strip and copper plates whose surfaces were subjected to a polished surface processsing as parallel flat conductors, a non-radiative dielectric waveguide (NRD guide) shown in FIG. 2 was prepared. In dispersion chacteristics of an LSM mode and an LSE mode determined by the dielectric constant and the shape of the dielectric strip, the difference between the dispersion curves of the two modes at $\beta/\beta_o=0$ is measured. [$\beta$ is a propagation constant in a dielectric strip, and $\beta_o$ is a propagation constant in vaccum]. The results are also shown in Tables 1 and 2.

TABLE 1

| Sample No. | Composition (mol %) MgO x | $Al_2O_3$ y | $SiO_2$ z | Additive ($Yb_2O_3$) (wt %) | Dielectric constant ($\epsilon r$) | Q value 60 GHz | Firing temperature (° C.) | Difference between LSM and LSE modes (GHz) |
|---|---|---|---|---|---|---|---|---|
| 1 | 5.0 | 55.0 | 40.0 | 10.0 | 6.8 | 520 | 1450~1550 | 15 |
| 2 | 10.0 | 10.0 | 80.0 | 10.0 | 4.8 | 1400 | 1350~1450 | 13 |
| 3 | 10.0 | 30.0 | 60.0 | 15.0 | 5.8 | 1820 | 1250~1350 | 14 |
| 4 | 10.0 | 40.0 | 50.0 | 0.1 | 5.8 | 1850 | 1400~1445 | 14 |
| 5 | 15.0 | 35.0 | 50.0 | 5.0 | 5.6 | 2121 | 1350~1445 | 14 |
| 6 | 17.5 | 17.5 | 65.0 | 5.0 | 4.8 | 2040 | 1300~1400 | 13 |
| 7 | 20.0 | 40.0 | 40.0 | 20.0 | 6.6 | 860 | 1300~1370 | 15 |
| 8 | 22.2 | 22.2 | 55.6 | — | 4.7 | 2810 | 1435~1445 | 13 |
| 9 | 22.2 | 22.2 | 55.6 | 0.1 | 4.8 | 2910 | 1425~1440 | 13 |
| 10 | 22.2 | 22.2 | 55.6 | 1.0 | 4.9 | 2670 | 1360~1420 | 13 |
| 11 | 22.2 | 22.2 | 55.6 | 5.0 | 4.8 | 2750 | 1330~1400 | 13 |
| 12 | 22.2 | 22.2 | 55.6 | 10.0 | 5.0 | 3010 | 1330~1370 | 13 |
| 13 | 22.2 | 22.2 | 55.6 | 15.0 | 5.4 | 2100 | 1330~1400 | 14 |
| 14 | 22.2 | 22.2 | 55.6 | 20.0 | 5.6 | 640 | 1300~1350 | 14 |
| 15 | 25.0 | 17.0 | 58.0 | 10.0 | 5.1 | 2490 | 1250~1350 | 13 |
| 16 | 25.0 | 27.0 | 48.0 | 10.0 | 5.6 | 2770 | 1250~1350 | 14 |
| 17 | 25.5 | 30.0 | 44.5 | 10.0 | 5.8 | 2120 | 1250~1350 | 14 |
| 18 | 30.0 | 10.0 | 60.0 | 5.0 | 5.2 | 1500 | 1250~1350 | 13 |
| 19 | 30.0 | 30.0 | 40.0 | 5.0 | 5.6 | 2500 | 1300~1400 | 14 |
| 20 | 35.0 | 20.0 | 45.0 | 10.0 | 6.0 | 2060 | 1250~1350 | 14 |
| 21 | 35.0 | 35.0 | 30.0 | 0.1 | 5.8 | 2080 | 1370~1445 | 14 |
| 22 | 40.0 | 10.0 | 50.0 | 10.0 | 5.8 | 1990 | 1250~1350 | 14 |
| 23 | 40.0 | 20.0 | 40.0 | 20.0 | 6.9 | 510 | 1200~1300 | 14 |
| 24 | 40.0 | 40.0 | 20.0 | 10.0 | 6.0 | 1470 | 1280~1380 | 14 |
| 25 | 40.0 | 50.0 | 10.0 | 5.0 | 7.9 | 520 | 1350~1400 | 15 |

TABLE 1-continued

| Sample No. | Composition (mol %) MgO x | $Al_2O_3$ y | $SiO_2$ z | Additive ($Yb_2O_3$) (wt %) | Dielectric constant (εr) | Q value 60 GHz | Firing temperature (° C.) | Difference between LSM and LSE modes (GHz) |
|---|---|---|---|---|---|---|---|---|
| 26 | 58.0 | 10.0 | 32.0 | 5.0 | 7.5 | 1250 | 1200~1250 | 15 |

TABLE 2

| Sample No. | Composition (mol %) MgO x | $Al_2O_3$ y | $SiO_2$ z | Additive | Amount of additive (wt %: calculated as $Re_2O_3$) | Dielectric constant (εr) | Q value 60 GHz | Firing temperature (° C.) | Difference between LSM and LSE modes (GHz) |
|---|---|---|---|---|---|---|---|---|---|
| 27 | 22.2 | 22.2 | 55.6 | $In_2O_3$ | 10 | 5.2 | 2540 | 1330~1370 | 13 |
| 28 | 22.2 | 22.2 | 55.6 | $Ga_2O_3$ | 10 | 5.0 | 2110 | 1350~1400 | 13 |
| 29 | 22.2 | 22.2 | 55.6 | $Sc_2O_3$ | 10 | 5.4 | 2150 | 1375~1420 | 14 |
| 30 | 22.2 | 22.2 | 55.6 | $Y_2O_3$ | 10 | 5.1 | 3100 | 1335~1380 | 13 |
| 31 | 22.2 | 22.2 | 55.6 | $Sm_2O_3$ | 10 | 5.1 | 2080 | 1330~1380 | 13 |
| 32 | 22.2 | 22.2 | 55.6 | $Ce_2O_3$ | 10 | 5.2 | 2410 | 1340~1385 | 13 |
| 33 | 22.2 | 22.2 | 55.6 | $La_2O_3$ | 5 | 4.9 | 2100 | 1345~1400 | 13 |
| 34 | 22.2 | 22.2 | 55.6 | $Fr_2O_3$ | 5 | 5.0 | 2070 | 1340~1400 | 13 |
| 35 | 22.2 | 22.2 | 55.6 | $Nd_2O_3$ | 5 | 4.7 | 2260 | 1335~1395 | 13 |
| 36 | 22.2 | 22.2 | 55.6 | $Eu_2O_3$ | 5 | 4.8 | 2200 | 1335~1395 | 13 |
| 37 | 22.2 | 22.2 | 55.6 | $Gd_2O_3$ | 5 | 4.8 | 2230 | 1335~1395 | 13 |
| 38 | 22.2 | 22.2 | 55.6 | $Tb_2O_3$ | 5 | 4.7 | 2190 | 1330~1390 | 13 |
| 39 | 22.2 | 22.2 | 55.6 | $Dy_2O_3$ | 5 | 4.8 | 2330 | 1335~1395 | 13 |
| 40 | 22.2 | 22.2 | 55.6 | $Ho_2O_3$ | 5 | 4.9 | 2490 | 1340~1400 | 13 |
| 41 | 22.2 | 22.2 | 55.6 | $Er_2O_3$ | 5 | 4.9 | 2430 | 1340~1400 | 13 |
| 42 | 22.2 | 22.2 | 55.6 | $Tm_2O_3$ | 5 | 4.7 | 2750 | 1340~1400 | 13 |
| 43 | 22.2 | 22.2 | 55.6 | $Lu_2O_3$ | 5 | 4.9 | 2940 | 1340~1400 | 13 |

According to Table 1, the cordierite ceramic of this invention has a dielectric constant of 4.7 to 7.9, and a high Q value at a frequency of 60 GHz of at least 510, especially at least 1000. It is also understood that the range of the firing temperature was broadened as the content of Yb increased.

It is also understood that in the dispersion characteristics of the LSM mode and the LSE mode, the dispersion curves of the two modes are separated from each other by at least 13 GHz at $\beta/\beta_o=0$.

Figure 20:
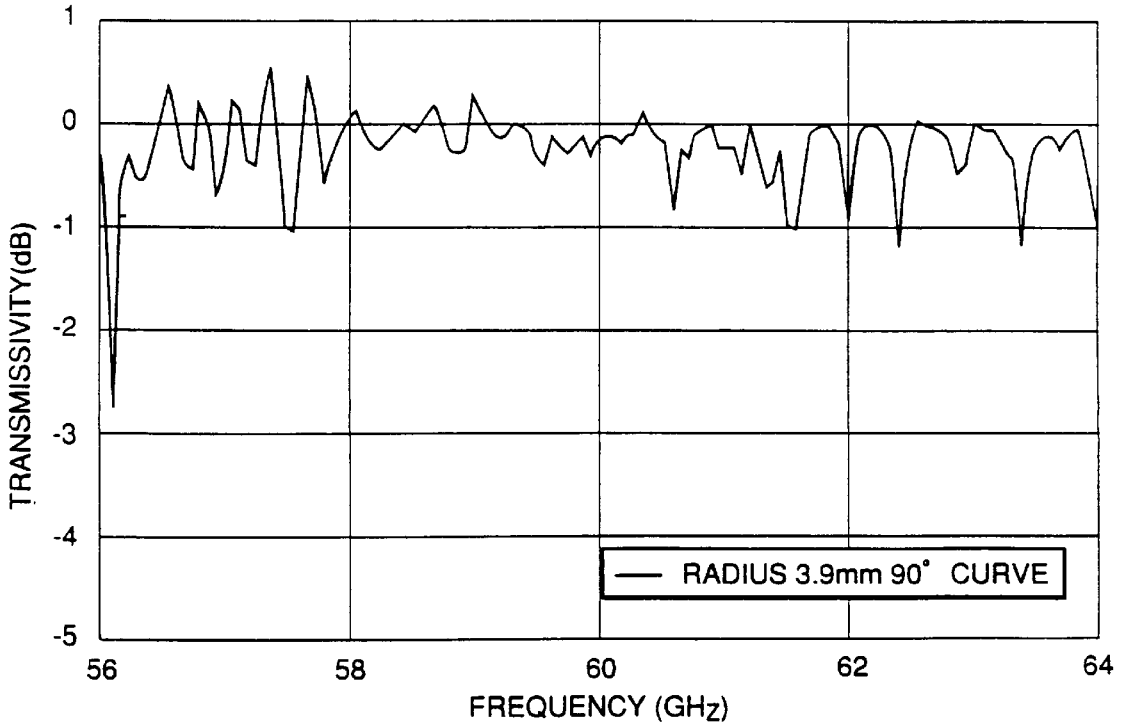
FIG. 20 is a view showing the frequency dependence of a transmission loss in a curved portion of a strip line, with respect to an NRD guide formed by using a strip of Sample No. 12 in Experimental Example 1.

The frequency dependence of the transmission loss of the NRD guide prepared by using a ceramics of Sample No. 12 in Table 1 is shown in FIG. 20. Insertion loss was not greater than 1 dB over a frequency of several GHz in a steep curved portion having a radius of 3.9 mm.

Figure 21:
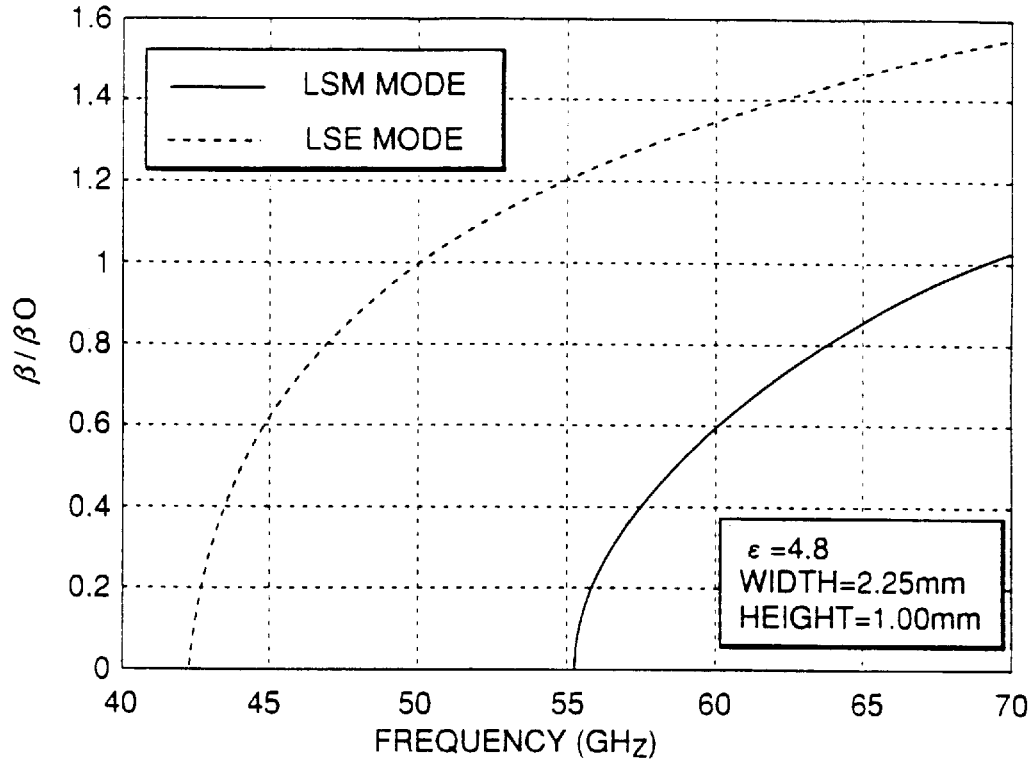
FIG. 21 shows a dispersion curve of LSM mode and LSE mode in the NRD guide of FIG. 20.
Figure 22:
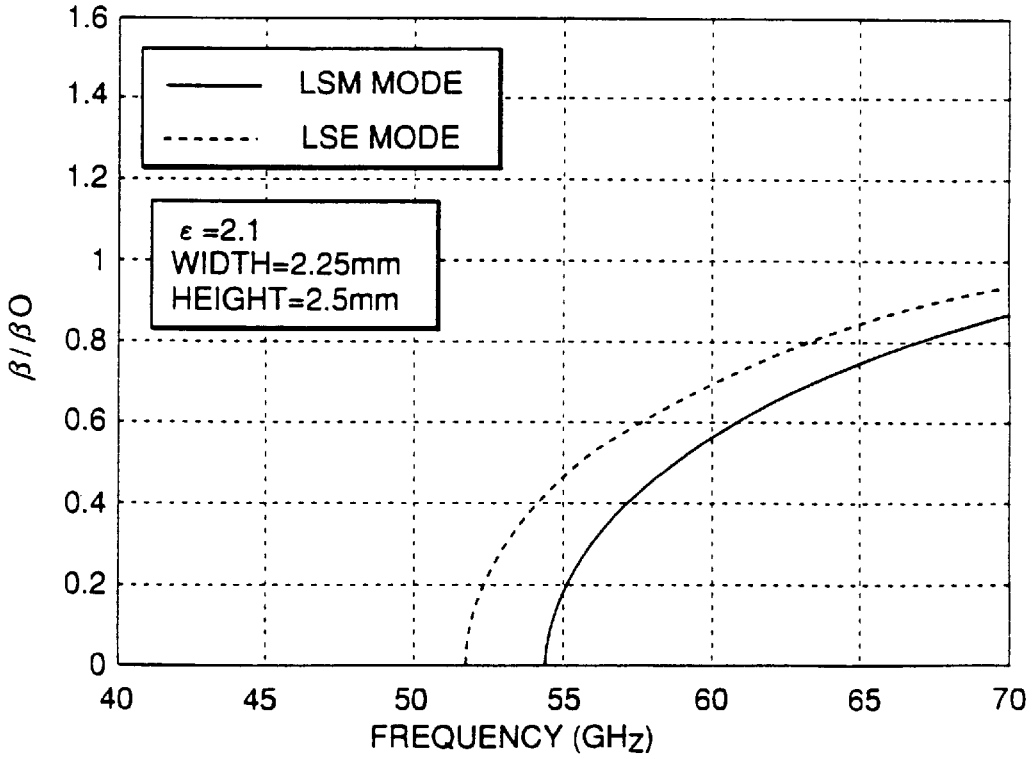
FIG. 22 shows a dispersion curve of LSM mode and LSE mode in the NRD guide in which the strip is formed of Teflon having a dielectric constant of 2.1.

With respect to the NRD guide using the ceramics of Sample 12, FIG. 21 shows dispersion curves of the LSM mode and the LSE mode. Furthermore, for the purpose of comparison, with respect to an NRD guide in which the strip was formed by using Teflon having a dielectric constant of 2.1, the same dispersion curve is shown in FIG. 22. It is understood from the dispersion curves shown in FIG. 21 that in comparison with FIG. 22 using Teflon, the dispersion curves of the two modes are separated from each other greatly by 13 GHz at $\beta/\beta_o$. For this reason, the LSM mode and the LSE mode are difficult to be coupled, and such a steep curved portion can be prepared.

EXPERIMENTAL EXAMPLE 2

First, two parallel flat conductors having 100×100×8 mm and composed of copper were provided. Three conductor patterns (2 mm in width and 18 mm in length) were formed by a vacuum evaporation method on an acetate film having a longitudinal length of 50 mm, a transverse length of 20 mm and a thickness of 0.08 mm, and the film was adhered to the upper surface of the lower parallel flat conductor by an adhesive material as shown in FIG. 3.

Thereafter, a dielectric strip composed of cordierite and having a height of 2.25 mm, a width of 1 mm and a length of 100 mm was arranged on a lower parallel flat conductor so that the line crossed the insulated film, and then the upper parallel flat conductor was adhered to the upper surface of the dielectric strip to prepare an NRD guide of this invention as shown in FIG. 3. FIG. 3 shows an example in which the insulated film was provided on the entire surface of the parallel flat conductor. However, in this example, the insulated film was provided in a part of the parallel flat conductor.

On the other hand, an NRD guide was prepared without adhering the insulated film.

Figure 23:
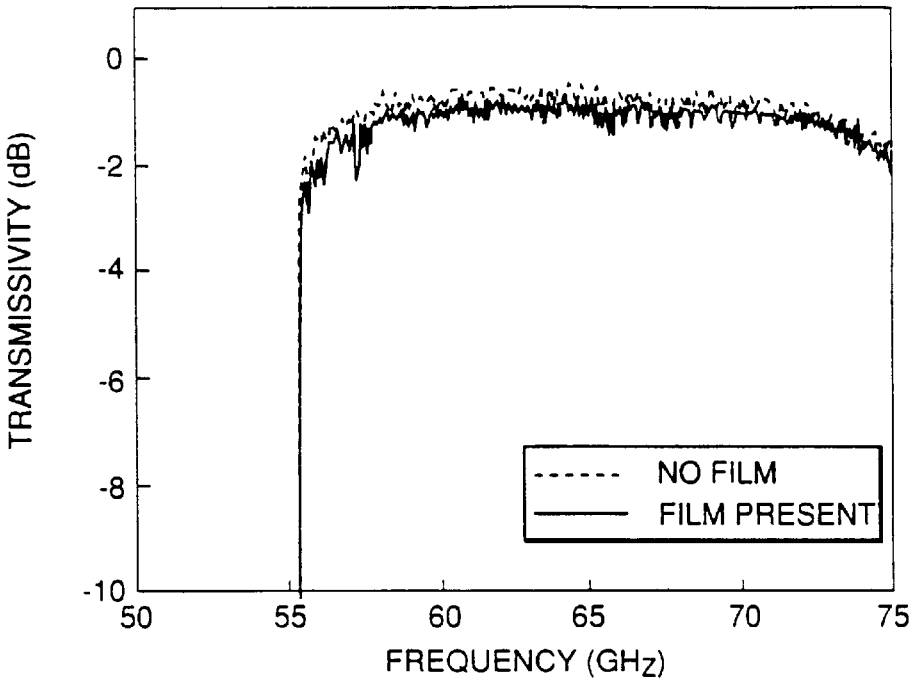
FIG. 23 is a view showing a trasmission loss of an NRD guide having an insulated film layer prepared by Experimental Example 2 on the surface of a parallel flat conductor and an NRD guide not having an insulated layer.

With respect to these dielectric lines, millimeter waves (several ten to several hundred GHz) transmission characteristics were measured, and the results are shown in FIG. 23. It was found that when the insulated film was provided and not provided, transmission characteristics of electromagnetic wave were almost the same. Even when the insulated film is provided between the strip and the parallel flat conductor, transmission characteristics of electromagnetic wave is hardly effected, and it is understood that electron component parts can be mounted.

EXPERIMENTAL EXAMPLE 3

An NRD guide shown in FIG. 7 was prepared by the following method. Two parallel flat conductors composed of Cu and having a size of 100×100×8 mm were provided, and a Teflon film having a thickness of 0.1 mm was adhered by an adhesive agent as an insulated layer 28 to one main surface of the lower parallel flat conductor. Au for a choke pattern 29 was formed by a vacuum-evaporation method on the surface of the Teflon film. Conductors 20 were secured to both-end portions in the longitudinal direction of the choke pattern 29 by a solder, and the conductors were connected to an outside through the hole 21 provided in the parallel flat conductor 1. To keep insulation, the conductors were used by passing them through a Teflon tube.

Then, a strip 2 having a height of 2.25 mm and a width of 1 mm and composed of cordierite was arranged to cross the central portion of the choke pattern 29 and bonded. At this time, by dividing the strip 2 into two portions at the central portion of the choke pattern 29, a dielectric substrate 25 for securing the semi-conductor element 27 was arranged in the central portion of the choke pattern 29, and an electrode 30 was connected to the choke pattern 29 by using an electro-conductive adhesive agent.

As the semi-conductor element 27, a beam lead type PIN diode was used to impart a switching function to an NRD guide.

Figure 24:
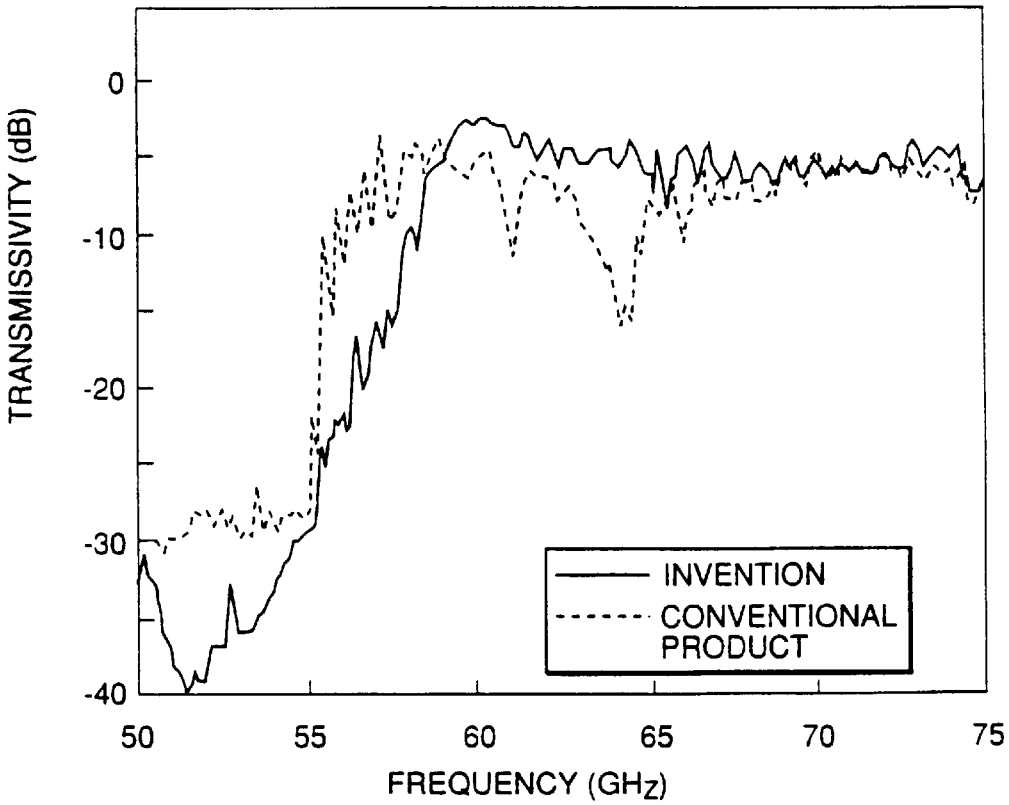
FIG. 24 is a graphic representation showing a comparison of millimeter wave transmission characteristics of an NRD guide corresponding to FIGS. 7 and 5 prepared in Experimental Example 3.

An NRD guide shown in FIG. 5 was prepared by using a strip 2 and a dielectric substrate 15 composed of cordierite, a choke pattern 16 and an antenna pattern 17 composed of Au, and a beam lead type PIN diode. Millimeter wave (several ten to several hundred GHz) transmitting characteristics are shown in FIG. 24 in which the transmitting characteristics were compared with the sample of the present invention. At a frequency of at least about 60 GHz, leakage of a high frequency signal to an outside was hampered by the choke pattern. However, in the conventional product, since the dielectric substrate 15 acts as a waveguide for the high frequency signal, the electromagnetic waves are leaked outwardly, and the millimeter waves are deteriorated in transmission characteristics.

EXPERIMENTAL EXAMPLE 4

An NRD guide shown in FIG. 8 was prepared in the following manner. Two parallel flat conductors composed of Cu and having a size of 100×100×8 mm were provided.

Next, a Teflon sheet having a thickness of 0.3 mm was used as a material for dielectric plates 45 and 46 to form a signal input or output device 40. First, an antenna pattern 47 and a choke pattern 48 were formed by vacuum-evaporation method of gold on the dielectric plate 46. Simultaneously, a surface electrode 50 connected to the choke pattern 48 was formed on the upper surface of the dielectric plate 46.

As the semi-conductor element 49, a beam lead-type PIN diode for high frequency signals was used, and the diode was adhered between antenna patterns 47 of the dielectric plate 46 by using an electroconductive adhesive agent.

A concave portion 51 having a size conforming to the diode was prepared in the other dielectric plate 45, and this dielectric plate 45 and the dielectric plate 46 to which the diode was secured were pasted with an adhesive agent.

Thereafter, the strip 2 having a height of 2.25 mm and a width of 1 mm and composed of cordierite was arranged on the lower parallel flat conductor 1, and the signal input or output device 40 was adhered on the way of the strip 2 so that the strip 2 crossed the central portion of the choke pattern 48.

The conductor coated with a Teflon tube was connected to the surface electrode 50 formed on the upper surface of the dielectric plate 46. Then, a hole corresponding to the surface electrode 50 was formed on the upper parallel flat conductor 1, and this conductor was passed through the hole.

Figure 25:
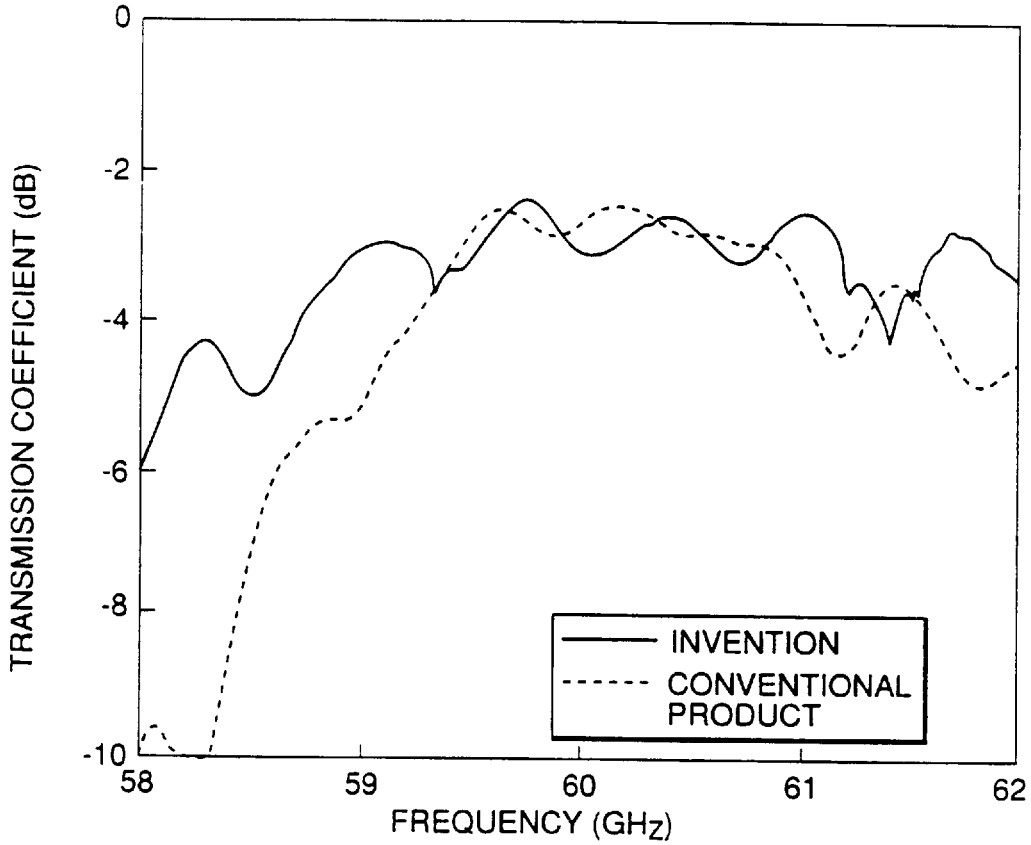
FIG. 25 is a graphic representation showing a comparison of millimeter wave transmission characteristics of an NRD guide corresponding to FIGS. 8 and 5 prepared in Experimental Example 4.

On the other hand, the conventional product shown in FIG. 5 was constructed by using a dielectric strip and a dielectric substrate composed of cordierite, a choke pattern and an antenna pattern composed of Au and a beam lead-type PIN diode. Millimeter wave (several ten to several hundred GHz) transmission characteristics are shown in FIG. 25 in which the above transmission characteristics of the conventional product are shown in comparison with the sample of the invention. This graphic representation shows that in the NRD guide of this invention, the width of frequency band which has good transmission characteristics of high frequency signals can be broadened over the conventional product.

EXPERIMENTAL EXAMPLE 5

Two parallel flat conductors having a longitudinal size of 100 mm, a transverse size of 100 mm and a thickness of 8 mm and composed of Cu were provided. A strip 2 composed of cordierite and having a height of 2.25 mm, a width of 1 mm and a length of 30 mm was arranged between these parallel flat conductors, and a NRD guide shown in FIG. 12 was constructed in the following manner. Incidentally, an electromagnetic wave absorber was provided only in the terminal portion 75 of the strip 2.

The strip piece 75 for the terminator had the same material and sectional shape as the strip 2, and had a length of 16 mm. As shown in FIGS. 14A and 14B, the upper end portion and the lower end portion of both side surfaces were coated with a paste of a resistance material composed of a carbon-containing paste, and dried to form a pattern of the electromagnetic wave absorber 71. The length of the absorber 71 was 16 mm which was the same as the terminator strip piece 75. In this absorber, the portion (8 mm) near the strip 2 was made a taper portion 71*a*, and the width of the belt-like portion 71*b* was adjusted to 0.8 mm.

On the other hand, a conventional NRD guide having a terminator 60 shown in FIG. 11A was constructed by using the same materials as mentioned above. In this case, two types of NRD guide in which the length of a terminator had lengths of 16 mm and 20 mm were constructed. The length of the electromagnetic wave absorber was adjusted to 16 mm and 20 mm which are the same as the length of the terminator. The taper portion had a length of 8 mm and 10 mm which were half of the length of the absorber.

Figure 26:
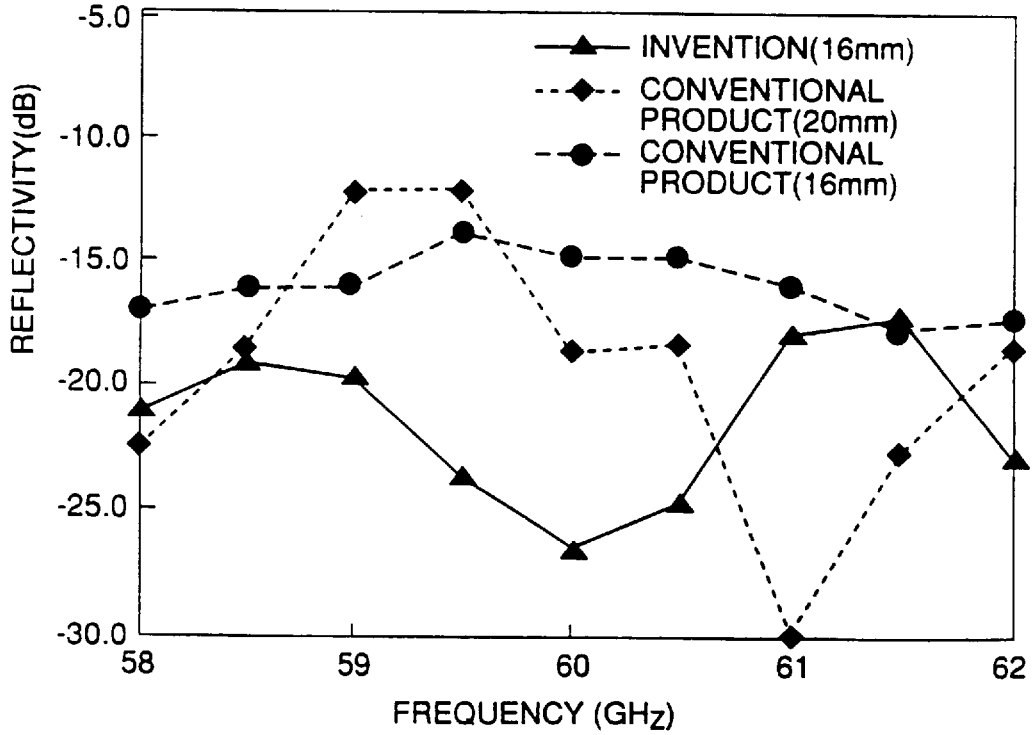
FIG. 26 is a view showing reflection characteristics with respect to a dielectric strip equipped with a terminator shown in FIG. 11(*a*) and a dielectric strip having a terminator shown in FIG. 14 and prepared in Experimental Example 5.

With respect to the NRD guide of the invention and the conventional product, reflecting characteristics of millimeter wave (several ten to several hundred GHz) were measured by a network analyzer [8757C] manufactured by Hewlett Packard, and the results are shown in FIG. 26.

FIG. 26 showed that the sample of the present invention had a small reflectivity even when the length of the electromagnetic wave absorber was shortend, and the product of the invention had good terminator characteristics.

Figure 27:
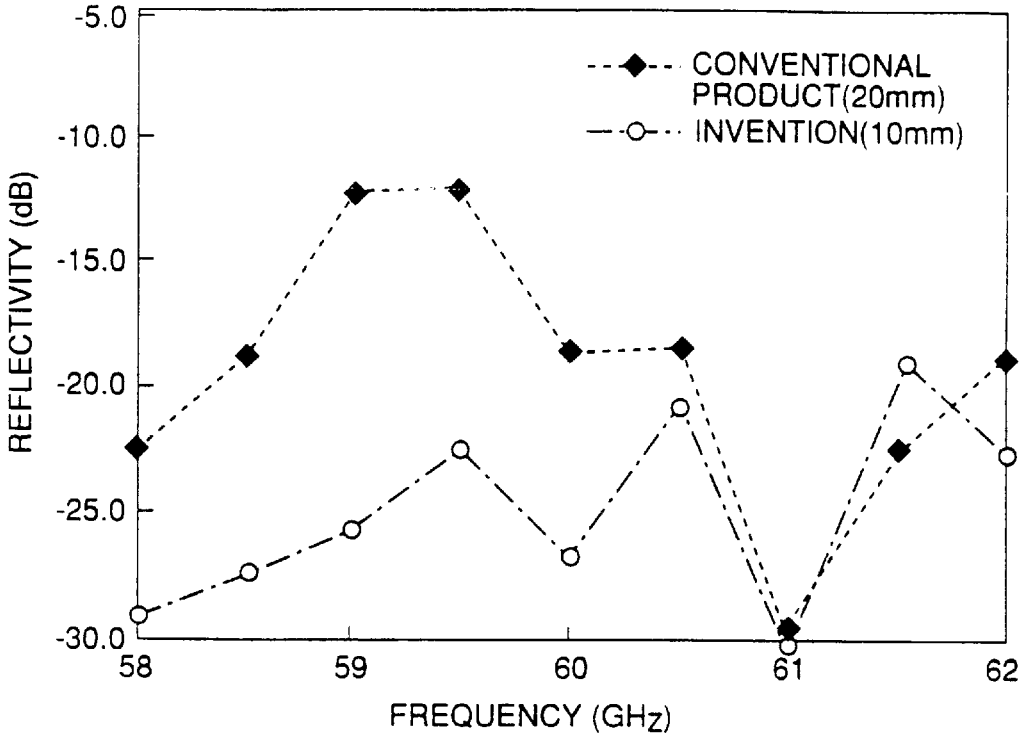
FIG. 27 is a view showing reflection characteristics with regard to a dielectric strip in which an electromagnetic wave absorber was provided on a side surface of the terminator shown in FIG. 11(*a*) and prepared in Experimental Example 5.

The terminator shown in FIG. 11A was prepared in the same way as above by adjusting the length of the terminator to 10 mm. The same electromagnetic wave absorber 71 (length 10 mm) was pasted to the side surface of the terminator. With respect to the NRD guide in which the terminator was secured to the strip 2, reflection properties were measured, and the results are shown in FIG. 27. As a result, when the absorber 71 was provided on a side surface, even if the length was decreased to half, the reflectivity becomes smaller, and good decaying characteristics were shown.

EXPERIMENTAL EXAMPLE 6

Two parallel flat conductors having a longitudinal size of 100 mm, a transverse size of 100 mm and a thickness of 8 mm composed of Cu were provided. A first linear strip and a second curved strip composed of cordierite having a dielectric constant of 4.8 and having a height of 2.25 mm and a width of 1 mm were arranged between these parallel flat conductors. Non-symmetrical couplers shown in FIG. 16 were prepared in the following manner.

This Experimental Example shows the case of preparing couplers in which high frequency signals were equally distributed to the port b and the port c at 60 GHz.

The first linear strip having a length of 80 mm was used, and its both ends were connected to a measuring waveguide through a converter. The second curved strip having a radius of curvature of 3.9 mm (180° bend, semi-circular shape) was used, and a linear strip was connected to its both ends, and was connected to the measuring waveguide through the converter.

A space between the first linear strip and the second curved strip was determined experimentally to be 1.4 mm so that the transmissivity would have an extreme value at 60 GHz. Furthermore, for the sake of comparison, as a conventional coupler, a symmetrical coupler having two 180° bends having a radius of curvature of 12.7 mm was constructed.

Figure 28:
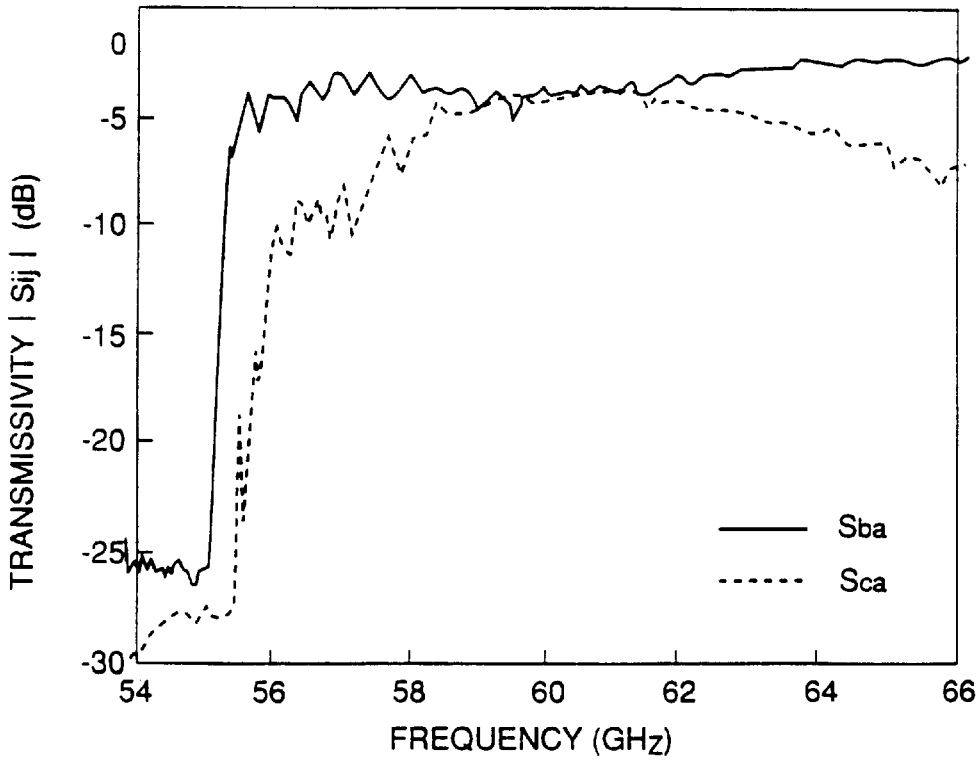
FIGS. 28 and 29 show a view of millimeter waves transmission characteristics of the couplers in accordance with this invention and prepared in Experimental Example 6.
Figure 29:
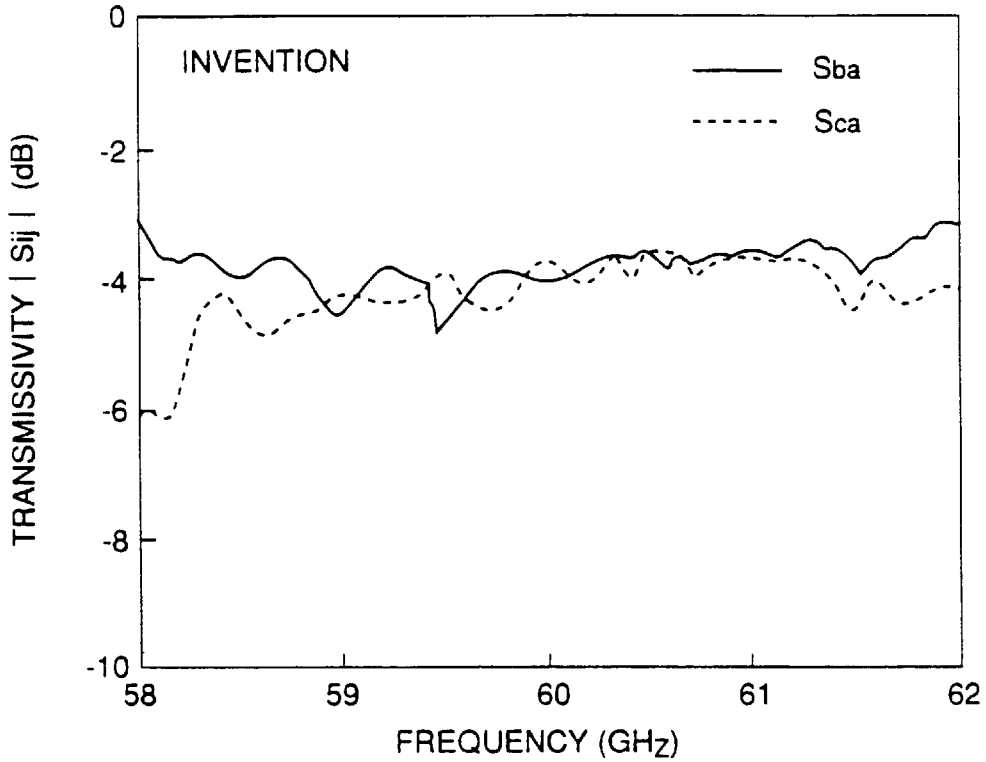
Figure 30:
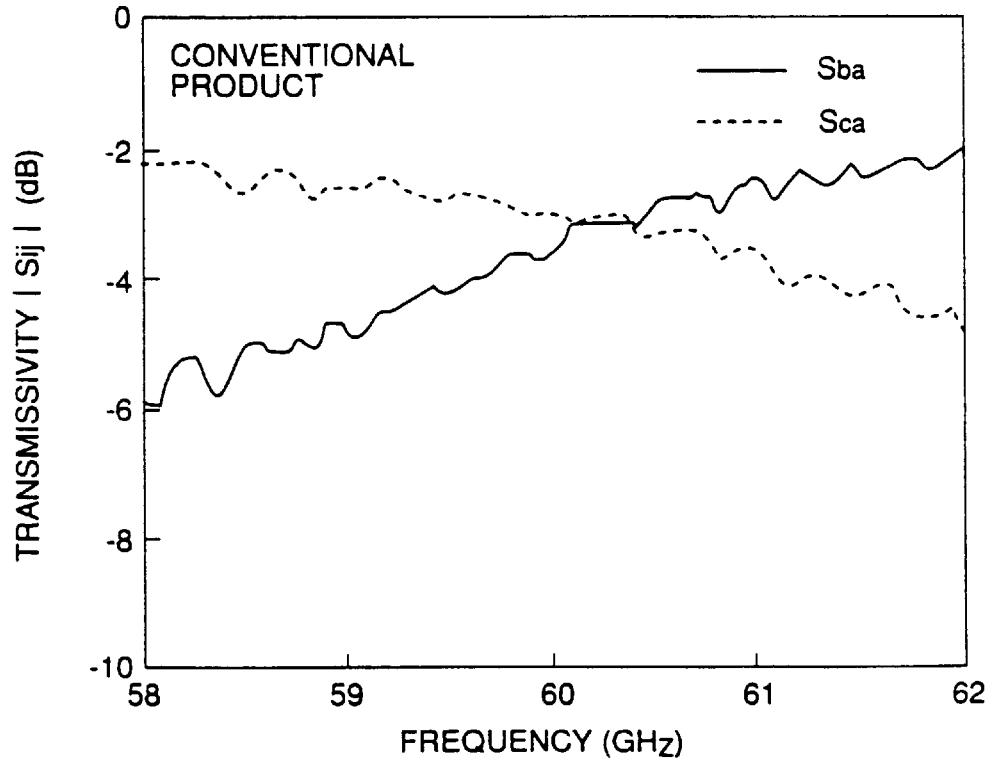
FIG. 30 is a view showing millimeter wave transmission characteristics of a coupler prepared by a conventional method in Experimental Example 6.

With regard to the couplers of the invention and the conventional couplers, transmission characteristics of millimeter wave (several ten to several hundred GHz) were measured by a network analyzer [8757C] manufactured by Hewlett Packard. The results obtained by the couplers of this invention are shown in FIGS. 28 and 29, and the results obtained by the conventional couplers are shown in FIG. 30. Since the transmissivity given on the axis of ordinate in the figures included the loss of the converter, the actual transmissivity of the coupler alone became larger than the given value by about 1 dB.

It can be understood from FIGS. 28 and 29 that with regard to the couplers of this invention, almost equal high frequency signals were distributed to the port b and the port c over a wide frequency range of about 59 to 61.5 GHz, and that with regard to the conventional couplers, when the high frequency signals were equally distributed to the port b and the port c, the frequency rage was limited to a narrow range of 60 to 60.5 GHz.

What is claimed is:

1. A module of a non-radiative dielectric waveguide comprising a pair of parallel flat conductors spaced from each other and a dielectric strip arranged between the parallel flat conductors, wherein the dielectric strip is formed from a dielectric having a dielectric constant of 4.5 to 8, wherein:

(a) said dielectric is a cordierite ceramic composed of a complex oxide containing Mg, Al and Si in the mole composition represented by formula $$xMgO.yAl_2O_3.zSiO_2,$$

wherein $x+y+z=100$, $10 \leqq x \leqq 40$, $10 \leqq y \leqq 40$, $20 \leqq z \leqq 80$, and (b) said dielectric has a quality factor Q of at least 1000 at 60 GHz.

2. A module of a non-radiative dielectric waveguide according to claim 1, wherein said dielectric constant is 4.5 to 6.

3. A module of a non-radiative dielectric waveguide according to claim 1, wherein an insulated film is provided on the dielectric strip side surface of the parallel flat conductor.

4. A module of a non-radiative dielectric waveguide according to claim 3, wherein the insulated film is arranged between the dielectric strip and the parallel flat conductor.

5. A module of a non-radiative dielectric waveguide according to claim 3, wherein electronic component parts are provided and a conductor pattern is formed on the insulated film.

6. A module of a non-radiative dielectric waveguide according to claim 1, wherein on the way of the dielectric strip, a pair of antenna patterns and a semi-conductor element connected electrically to and arranged between the antenna patterns are provided, and a choke pattern is formed via an insulated layer on the parallel flat conductor, and the choke pattern is connected to the antenna pattern.

7. A module of a non-radiative dielectric waveguide according to claim 1, wherein a signal input or output device is interposed on the way of the dielectric strip, and the signal input or output device is composed of a dielectric substrate containing a pair of antenna patterns, a semi-conductor element connected electrically and arranged between the antenna patterns, and a choke pattern connected to each of the antenna patterns.

8. A module of a non-radiative dielectric waveguide according to claim 7, wherein a surface electrode electrically connected to the choke pattern is formed on the surface of the dielectric substrate, a conductor is connected to the surface electrode and the conductor extends in a non-conducting state with respect to the parallel flat conductor through a hole formed on the parallel flat conductor.

9. A module of a non-radiative dielectric waveguide according to claim 1, wherein an electromagnetic wave absorber is provided on a side surface on the way of the strip or in the terminal portion of the strip.

10. A module of a non-radiative dielectric waveguide according to claim 9, wherein the electromagnetic wave absorber is provided in an upper end portion or a lower end portion on the side surface of the strip.

11. A module of a non-radiative dielectric waveguide according to claim 9, wherein the electromagnetic wave absorber has a taper portion which gradually becomes wider toward the propagation direction of an electromagnetic wave.

12. A module of a non-radiative dielectric waveguide comprising a pair of parallel flat conductors spaced from each other and a dielectric strip arranged between the conductors, wherein said dielectric strip is formed from a cordierite ceramic comprising a complex oxide containing Mg, Al, Si and a Group 3*a* element of the periodic table.

13. A module of a non-radiative dielectric waveguide according to claim 12, wherein the Group 3*a* element in the periodic table is Yb, and per the complex oxide, Yb is contained in an amount of 0.1 to 15% by weight calculated as $Yb_2O_3$.

14. A module of a non-radiative dielectric waveguide according to claim 12, wherein when the composition of metal elements of the complex oxide is expressed by the following formula by mol ratio $$xMgO.yAl_2O_3.zSiO_2$$

where x, y and z satisfy $x+y+z=100$, x, y and z satisfy the following conditions $10 \leqq x \leqq 40$, $10 \leqq y \leqq 40$, $20 \leqq z \leqq 80$.

15. A module of a non-radiative dielectric waveguide according to claim 12, wherein an insulated film is provided on the dielectric strip side surface of each parallel flat conductor.

16. A module of a non-radiative dielectric waveguide according to claim 15, wherein the insulated film is arranged between the dielectric strip and the parallel flat conductor.

17. A module of a non-radiative dielectric waveguide according to claim 15, wherein electronic component parts are provided and a conductor pattern is formed on the insulated film.

18. A module of a non-radiative dielectric waveguide according to claim 12, wherein on the way of the dielectric strip, a pair of antenna patterns and a semiconductor element connected electrically to and arranged between the antenna patterns are provided, and a choke pattern is formed via an insulated layer on the parallel flat conductor, and the choke pattern is connected to the antenna pattern.

19. A module of a non-radiative dielectric waveguide according to claim 12, wherein a signal input or output device is interposed on the way of the dielectric strip, and the signal input or output device is composed of a dielectric substrate containing a pair of antenna patterns, a semiconductor element connected electrically and arranged between the antenna patterns, and a choke pattern connected to each of the antenna patterns.

20. A module of a non-radiative dielectric waveguide according to claim 19, wherein a surface electrode electrically connected to the choke pattern is formed on the surface of the dielectric substrate, a conductor is connected to the surface electrode and the conductor extends in a non-conducting state with respect to the parallel flat conductor through a hole formed on the parallel flat conductor.

21. A module of a non-radiative dielectric waveguide according to claim 12, wherein an electromagnetic wave absorber is provided on a side surface on the way of the strip or in the terminal portion of the strip.

22. A module of a non-radiative dielectric waveguide according to claim 21, wherein the electromagnetic wave absorber is provided in an upper end portion or a lower end portion on the side surface of the strip.

23. A module of a non-radiative dielectric waveguide according to claim 21, wherein the electromagnetic wave absorber has a taper portion which gradually becomes wider toward the propagation direction of an electromagnetic wave.

* * * * *